US005111164A

United States Patent [19]

De Ronde

[11] Patent Number: 5,111,164

[45] Date of Patent: May 5, 1992

[54] MATCHING ASYMMETRICAL DISCONTINUITIES IN A WAVEGUIDE TWIST

[75] Inventor: Frans C. De Ronde, Bath, England

[73] Assignee: National Research Development Corporation, London, United Kingdom

[21] Appl. No.: 422,020

[22] Filed: Oct. 16, 1989

[30] Foreign Application Priority Data

| | | | |
|---|---|---|---|
| May 29, 1986 | [GB] | United Kingdom | 8613028 |
| Apr. 8, 1987 | [GB] | United Kingdom | 8708373 |
| May 21, 1987 | [GB] | United Kingdom | 8712030 |
| Mar. 15, 1989 | [CA] | Canada | 593723 |

[51] Int. Cl.[5] ..... H01P 1/02; H01P 1/165

[52] U.S. Cl. ..... 333/21 A; 333/248

[58] Field of Search ..... 333/21 A, 21 R, 248, 333/254

[56] References Cited

U.S. PATENT DOCUMENTS

| | | | |
|---|---|---|---|
| 2,584,162 | 2/1952 | Sensiper et al. | 333/122 |
| 2,668,191 | 2/1954 | Cohn | 333/21 A |
| 2,975,383 | 3/1961 | Seling | 333/21 A X |
| 2,985,850 | 3/1961 | Crawford et al. | 333/21 R X |
| 3,024,463 | 3/1962 | Moeller et al. | 333/21 A X |
| 3,651,435 | 3/1972 | Riblet | 333/248 |
| 4,260,961 | 4/1981 | Beis | 333/21 A |
| 4,413,242 | 11/1983 | Reeves et al. | 333/122 |

FOREIGN PATENT DOCUMENTS

| | | | |
|---|---|---|---|
| 170201 | 10/1983 | Japan | 333/21 A |
| 1337938 | 9/1987 | U.S.S.R. | 333/21 A |

OTHER PUBLICATIONS

Japanese Abstract of Int. Cl. H01P1/02.

IEEE Transactions on Microwave Theory and Techniques, vol. MIT-33, No. 6, Jun. 1985, "Archer and Faber", pp. 534-536.

IRE Transactions-Microwave Theory and Techniques "Step-Twist Waveguide Components", Wheeler and Schwiebert, 10-55, pp. 44-52.

15th European Microwave Confer, Conference Proceedings, Sep. 85, pp. 330-334.

*Primary Examiner*—Paul Gensler

*Assistant Examiner*—Benny Lee

*Attorney, Agent, or Firm*—Cushman, Darby & Cushman

[57] ABSTRACT

The invention relates to matching asymmetrical discontinuities in transmission lines to give low reflection coefficients (less than five percent) over a wide frequency band (corresponding to at least an octave in wavelength). A group of asymmetrical discontinuities, such as impedance steps in a waveguide, are matched by considering a reference plane whose position varies with frequency at which the reflection coefficient for waves transmitted in one direction is equal to that for waves transmitted in the opposite direction. Matching elements are then provided which have a reflection coefficient at the reference plane which is equal and opposite to the reflection coefficient of the discontinuities. Matching is less difficult if the distance between the steps is less than a quarter of a guide wavelength at all frequencies in the wide band mentioned above and such an arrangement is a "reduced quarter wave transformer". The technique of using the reference plane can also be applied to a single impedance step where two matching elements on either side of the step are required. The invention has application to, for example, waveguide transitions (including coaxial to waveguide transitions), waveguide twists, waveguide tees, symmetrical waveguide five ports, planar transmission lines, optical transmission lines and dielectric lenses. Waveguide twists, that is components for coupling two waveguides which are twisted in relation to one another, are usually several wavelengths long because a gradual rotation of the field preserves the field and avoids reflections. A very short twist is provided by the present invention and employs an aperture including a ridge. The twist functions by using the ridge to bind the electric field to a direction which is half-way between the electric fields in two waveguides coupled by the twist. Full band matching is also provided, in one instance by projections mounted on the ridge, at opposite ends thereof. Usually two opposed ridges are used, so that the aperture is "H" shaped in cross-section, with two pairs of the said projections, one pair at the end of each ridge.

24 Claims, 13 Drawing Sheets

MATCHING ASYMMETRICAL DISCONTINUITIES IN A WAVEGUIDE TWIST

Figure 1:
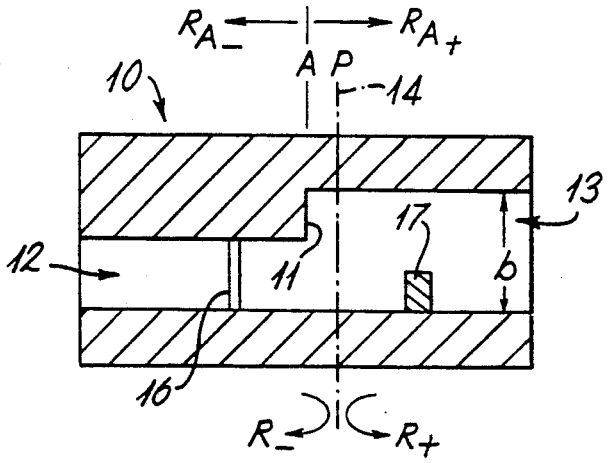

This is a continuation-in-part of Ser. No. 07/055,131, filed May 28, 1987; now U.S. Pat. No. 4,891,614.

The present invention relates to methods and apparatus for matching asymmetrical discontinuities in transmission lines. Such discontinuities may for example be in the form of steps or transitions from one set of dimensions to another or from one type of line to another.

Where impedance steps occur in waveguides some measure of matching can be achieved by the well known quarterwave transformer which comprises two equal reflection coefficient steps separated by a quarter of a guide wavelength. While this type of transformer provides matching at one frequency in a frequency band of operation, reflections occur at other frequencies. For example at the lowest and highest frequencies in the X-band the reflection coefficient is reduced to about half by the use of two steps instead of one. Further improvements in matching can be achieved by using more steps but at the cost of lengthening the matching section. Ultimately the number of steps can be increased until there is a smooth transition between one waveguide and the other and although such a taper provides good matching with a low reflection coefficient it has to be long compared with the wavelengths of the frequencies in the band to be transmitted. In the X-band the longest guide wavelength is 60 millimeters so such a transition must be, for example, at least 30 millimeters.

In this specification, including claims, a reference plane of a group of asymmetrical discontinuities (including one only) in a transmission path for electromagnetic waves, is the plane at which the reflection coefficient for waves transmitted towards the plane in one direction is equal to the reflection coefficient for waves transmitted towards the plane in the other direction. However, the two reflection coefficients at the reference plane are of opposite signs. Where, for example, the direction of propagation of a wave is changed by the discontinuities, the reference plane may not be a strictly geometrical plane.

According to a first aspect of the present invention there is provided a section of a transmission path for electromagnetic waves, comprising a group of asymmetrical discontinuities, and matching means so positioned that its reflection coefficient transferred to the reference plane, as hereinbefore defined, of the group of discontinuities, is substantially equal and opposite to the reflection coefficient at the said reference plane of the discontinuities over a frequency band corresponding to at least half an octave in wavelength and for each direction of transmission along the line.

Preferably the matching is full-band which means, in this specification, that the reflection is less than five percent over a frequency band corresponding to at least an octave in wavelength.

The above reference to wavelengths relates to the path concerned, for example in waveguides the wavelengths are guide wavelength. It will be appreciated that, for example, in waveguides that are an octave in wavelength (that is a 2:1 wavelength range) is not as an octave in frequency.

An advantage of the invention as applied to waveguides is that a discontinuity and its matching elements in the form of the said matching means can be contained in a length which is approximately equal to a quarter of a guide wavelength or less. Although this is comparable to a quarterwave transformer the matching provided is much better over the whole of an octave in wavelength. For example a reflection coefficient with a modulus less than 0.02 can be achieved in waveguides with significant discontinuities for the band 8.2 to 12.4 GHz.

The group of discontinuities may contain only one discontinuity when the reactive means may be formed by two reactive matching elements, one on one side of the said reference plane and one on the other side, and the matching elements each being spaced from the reference plane by substantially one eighth of the wavelength (determined in the said path) at the centre frequency of the said band.

If there are two unequal discontinuities only in the said group then both the position of the group's reference plane and its total reflection coefficient vary with frequency. In some embodiments of the invention the matching means is then positioned on one side of the reference plane and has a reflection coefficient transferred to the reference plane which varies with frequency across the said band by substantially the same amount as the total reflection coefficient of the two discontinuities at the reference plane for the same direction of transmission, the two coefficients being of opposite sign.

If two discontinuities are two impedance steps having reflection coefficients of the same sign separated by a distance equal to a quarter of a wavelength above the working frequency band, for example at an eighth of a wavelength in the band, then the magnitude of the reflection coefficient of the discontinuities increases or decreases with change in frequency across the whole band. Matching elements may then be used which have a similar variation of reflection coefficient with frequency to give full-band matching. The arrangement of two discontinuities separated by significantly less than a quarter of a wavelength in the working band and having a reflection coefficient which increases or decreases with frequency across the whole of the working band is known in this specification as a "reduced quarterwave transformer". It can be used as matching means in the present invention as well as forming, in some cases, the group of discontinuities. The reduced quarterwave transformer also forms a separate aspect of the invention.

Where the transmission lines are waveguides the discontinuities may be impedance steps in the waveguides or transitions from one type of waveguide to another. If at least two large steps are employed, waveguide design can be made less critical by including a tapered section, preferably of constant radius in the group of discontinuities.

The group of discontinuities can take many forms; for example they can be impedance steps and/or reactive discontinuities and they can include transmission line junctions, or components coupled to the transmission line.

According to a second aspect of the invention there is provided a method of matching a group of asymmetrical discontinuities in a transmission path, comprising so positioning matching means that its reflection coefficient transferred to the reference plane as hereinbefore defined of the group of discontinuities, is substantially equal and opposite to the reflection coefficient of the discontinuities over a frequency band corresponding to at least half an octave in wavelength, and for each direction of transmission.

According to a third aspect of the invention there is provided apparatus for radiating signals having frequencies in a predetermined band of at least half an octave, comprising a probe which projects from a conductive ground plane, and has a length electrically equal to a quarter wavelength at a frequency in the said band, a coaxial line with inner conductor connected to the probe and outer conductor connected to the ground plane, and matching means having a reference plane, as hereinbefore defined, which coincides at all frequencies in the said band with the reference plane of the transition between the coaxial line and free space, and the matching means having a reflection coefficient at the reference plane which is equal and opposite, at all frequencies in the said band, to the reflection coefficient of the transition.

The matching means may comprise a transmission line which is electrically a quarter of a wavelength long at a frequency above the said band.

The said transmission line may for example be formed by a section of further coaxial line connected between the coaxial line, and the probe and the ground plane. As an alternative the said transmission line may take the form of a projection by the said outer conductor from the ground plane.

The apparatus may form a transition from a coaxial line to a waveguide, when the radiating probe projects into the waveguide and the ground plane is formed by a waveguide wall.

The present invention can also be applied to coupling two rectangular waveguide sections which are twisted in relation to one another, that is the walls of one waveguide are not in the same respective planes as the walls of the other waveguide although the two waveguides have the same longitudinal axis. Coupling is by means of an intermediate waveguide section known as a twist.

Known twists between waveguides orientated at an angle are fairly lengthy, for example several wavelengths, because a gradual rotation of the field is used to preserve the magnetic and electric fields and avoid reflections. Another form of known twist uses a series of quarter wavelength sections successively rotated in relation to the previous section. Such twists are described by H. A. Wheeler and H. Schwiebert in "Step-Twist Waveguide Components" Trans. IRE 1955, MTT-3, page 45.

The objects of the invention therefore include providing an ultra-short twist and providing full-band matching especially for such a twist.

Most prior twists were for one direction of field rotation only and therefore a further object is to provide a twist which can be used for rotation in either direction.

According to a fourth aspect of the present invention there is provided a twist for coupling two rectangular waveguides when the waveguides are twisted in relation to one another, comprising conductive walls defining an opening which when the twist is positioned between two rectangular waveguides twisted in relation to one another allows communication between electromagnetic fields in the waveguides and in the opening.

the walls also defining a ridge having an axis of symmetry in the general direction of propagation through the opening, the ridge also having an axis of symmetry transverse to the said direction which in use is angularly displaced from the directions of both of transverse axes of symmetry of the waveguides which correspond with one another.

The twist may include matching means mounted on the ridge which either alone, or with further matching means, provide a significant degree of matching between the first and second waveguide sections over at least half an octave in the waveguide band of operation of the first and second waveguide sections.

Matching may be according to the first aspect of the invention. Thus if two sections of a transmission path each according to the first aspect are provided then the two sections may together form a twist for coupling two waveguides twisted in relation to one another, each section having first and second portions, the first portions of the two sections comprise respective rectangular waveguides twisted in relation to one another and the two second portions are joined together and form a short intermediate waveguide, the intermediate waveguide having an opening with first and second regions which allow wave propagation between the first and second regions and the first and second waveguides, respectively, each region at least partially including a ridge in the general direction of propagation through the opening, the ridge having a transverse axis at an angle between the directions of corresponding transverse axes of symmetry of the waveguides, the group of discontinuities in each section being formed by the interface between the first and second waveguide portions, and the matching means for each section comprising a capacitive element in that section and an inductive element common to both sections formed by the interface with the intermediate waveguide.

The said opening may have two opposed ridges which give the opening a cross-section in the general form of an "H" with the common longitudinal axis of the twisted waveguides passing through the centre area of the "H".

As an alternative the said opening may have the general form of an "L", with the ridge projecting from the intersection of the arms of the "L", and each arm communicates with a respective one of the twisted waveguides.

The ridge-mounted matching means may comprise a pair of spaced projections on the ridge, or a pair of spaced projections on each ridge, each projection being transverse to the ridge on which it is mounted.

The invention may also be applied to waveguide tees. For example two sections of transmission path according to the first aspect of the invention may together form such an E-plane tee, with each section being in the form of a right-angle waveguide corner, the two corners being back-to-back with one end of each section forming one respective port for the tee and the other ends of the sections together forming a third port.

According to a fifth aspect of the invention there is provided an E-plane waveguide tee comprising first and second waveguides joined end to end and a third waveguide opening into the junction of the first and second waveguides at right angles thereto and along one broad side of the junction, wherein each of the first and second waveguides includes a length of reduced cross-sectional area which is less than a quarter of a wavelength long at all frequencies over the band of the waveguides, the third waveguide contains an inductive matching element, and each first and second waveguide also includes a corner matching element to substantially remove reflections due to change of direction of propagation from the first and second waveguides to the third waveguide.

The waveguide tee of the fifth aspect of the invention may also be in the form of a "magic tee" by including, as a fourth port, a transmission line such as a coaxial or suspended strip line with one end opening into the first and second waveguides opposite the region where the third waveguide opens into the first and second waveguide.

The waveguide tee of the fifth aspect of the invention may also be in the form of a "magic tee" including a fourth waveguide opening into the junction of the first and second waveguides at right angles thereto and along one narrow side of the junction, and further matching means for matching the fourth waveguide to the junction.

According to a sixth aspect of the invention there is provided a five-port E-plane waveguide junction comprising five rectangular waveguides and a chamber into which the waveguides open with the planes of symmetry of the waveguides which are parallel to the broad sides thereof angularly separated by substantially 72°, and matching means for the waveguides in the form of an inductive diaphragm for each waveguide near the point where that waveguide opens into the chamber and a plurality of capacitive elements inside the chamber.

A further application of the invention is to a section of transmission path which comprises dielectrics having different dielectric constants with interfaces between the dielectrics encountered by waves propagating along the path; for example the group of discontinuities may comprise two interfaces between dielectrics having different dielectric constants, the interfaces being a quarter of a wavelength apart at a frequency above the said band, and the dielectric between the interfaces having a dielectric constant value between those of the dielectric constants on the other sides of the interfaces.

According to a seventh aspect of the invention there is provided a transmission path for use over a predetermined band of frequencies extending over at least half an octave including two interfaces between dielectrics having different dielectric constants, the interfaces being a quarter of a wavelength apart at a frequency above the said band, and the dielectric between the interfaces having a dielectric constant value between those of the dielectric constants on the other sides of the interfaces, and matching means comprising an inductance or a capacitance distributed over a planar region parallel to the region between the interfaces and separated from the said region.

According to an eighth aspect of the invention there is provided a method of transmitting electromagnetic waves along a transmission path including two interfaces between different dielectrics with the dielectric between the interfaces having a dielectric constant value between those of the dielectric constants on the other sides of the interfaces, and matching means comprising an inductance or a capacitance distributed over a planar region parallel to the interfaces and separated from the region, the method comprising transmitting waves over a band of frequencies at least half an octave wide, the highest frequency in the band having a wavelength which is more than four times the distance between the interfaces.

Figure 2A:
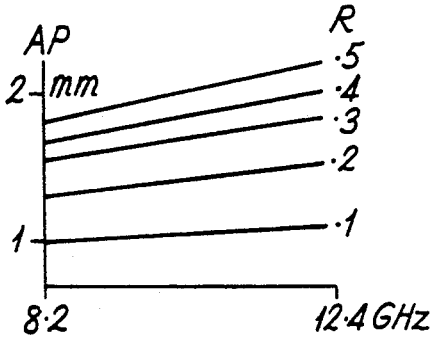
Figure 2B:
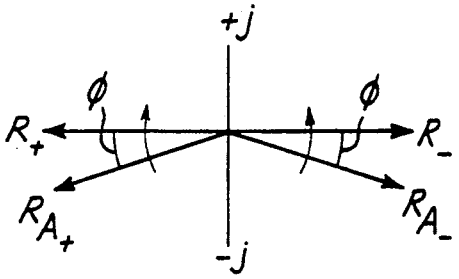
Figure 2C:
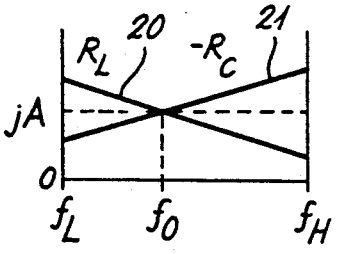
Figure 2D:
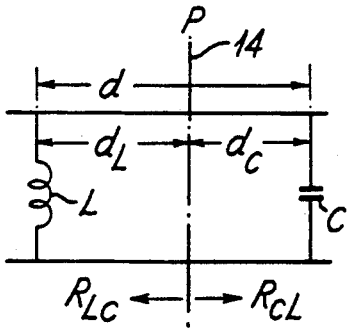
Figure 2E:
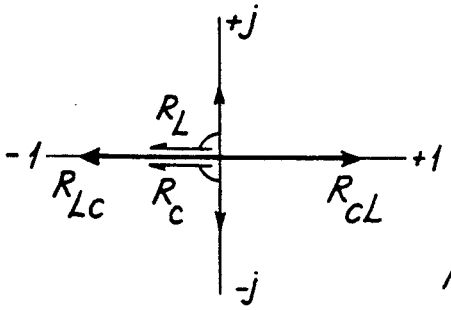
Figure 3:
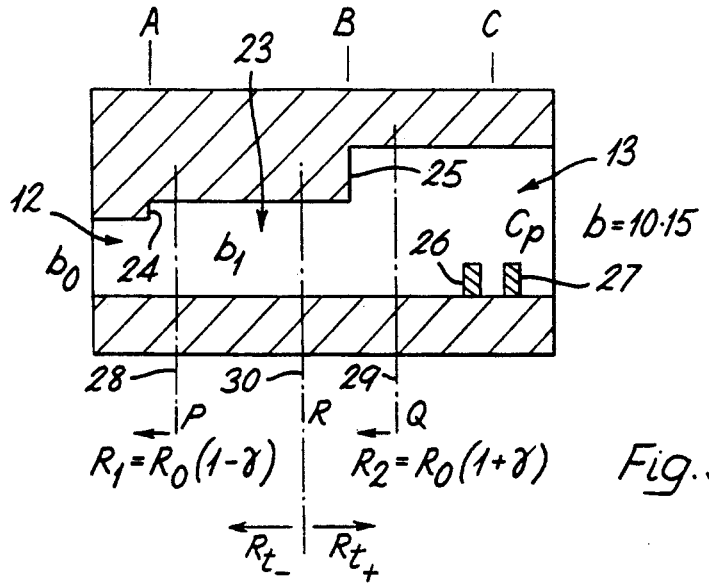
Figure 4A:
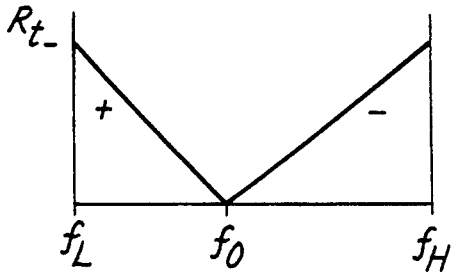
Figure 4B:
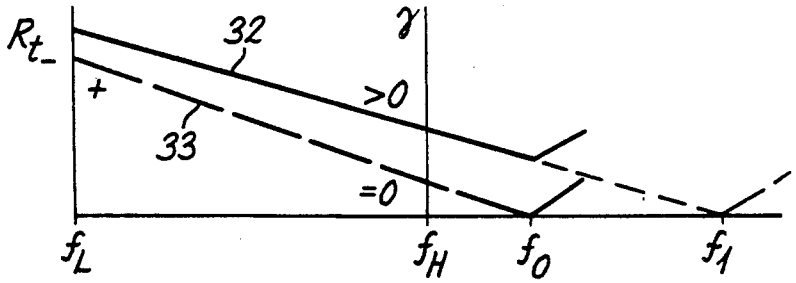
Figure 4C:
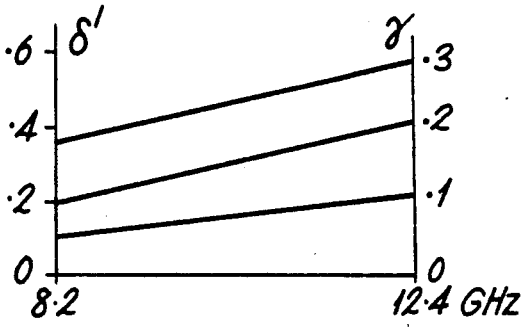

Certain embodiments of the invention will now be described, by way of example, with reference to the accompanying drawings, in which:

FIG. 1 is a longitudinal cross-section of a waveguide section according to the invention in which a single step is matched by shunt capacitive and inductive elements, FIGS. 2*a* to 2*e* comprise a circuit diagram, vector diagrams and graphs used in explaining the matching carried out in FIG. 1, FIG. 3 is a longitudinal cross-section of a transmission line section according to the invention containing two steps and capacitive matching means only, FIGS. 4*a* to 4*c* show graphs used in explaining the matching used in FIG. 3, FIGS. 5*a* to 5*g* show mode converters according to the invention.

FIGS. 6*a* to 6*d* show longitudinal sections of waveguide sections according to the invention in which constant radius tapers are used.

Figure 7:
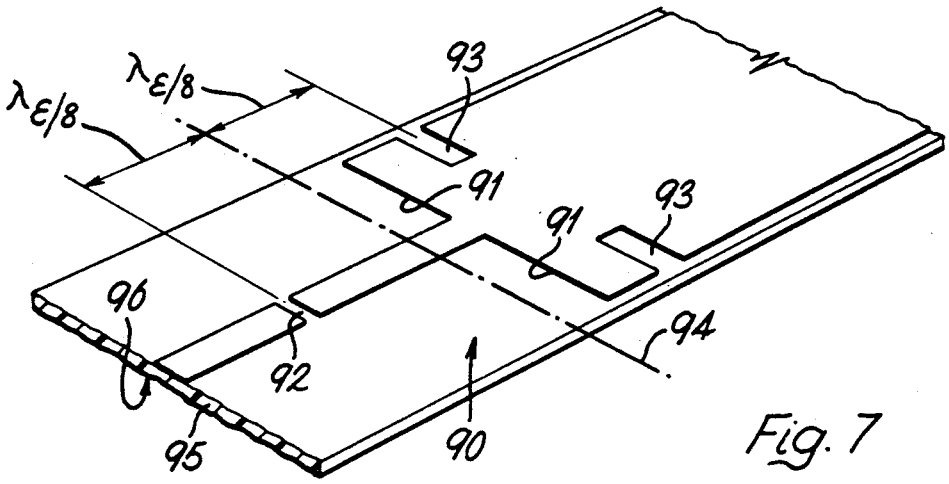
Figure 8A:
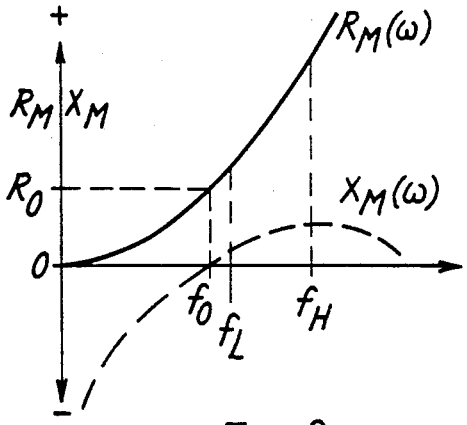
Figure 8B:
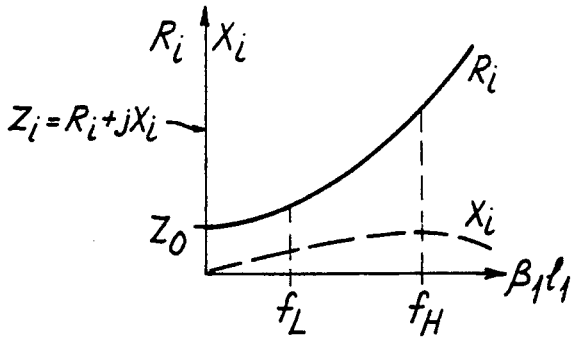

FIG. 7 is a plan view of a microstrip transmission line with a single discontinuity matched by series reactive elements, FIGS. 8*a* and 8*b* show the impedance of a monopole and that of a reduced quarterwave transformer versus frequency, respectively.

Figure 9:
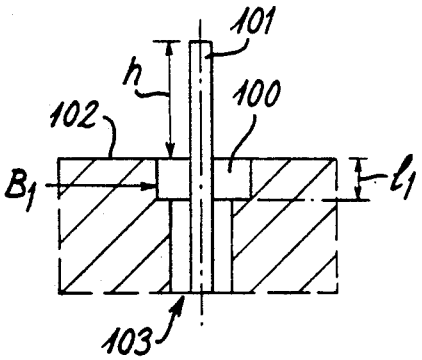
Figure 10:
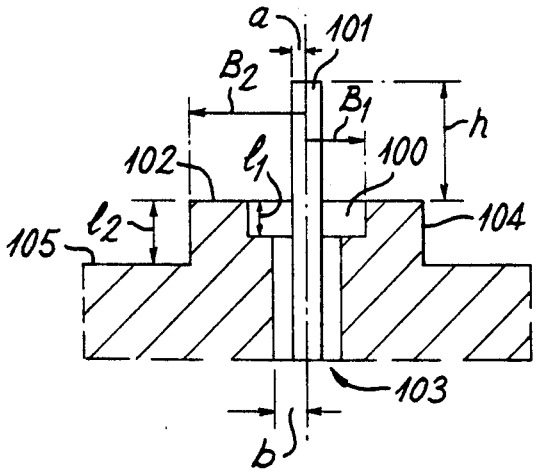
Figure 11A:
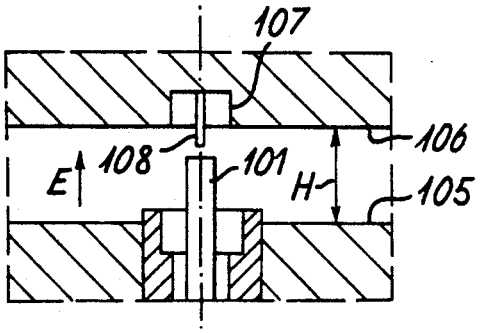
Figure 11B:
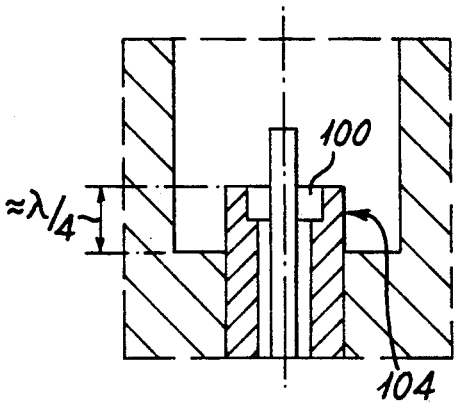
Figure 12A:
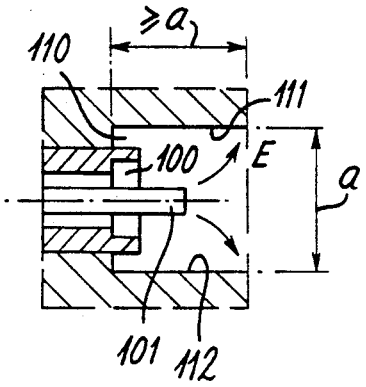
Figure 12B:
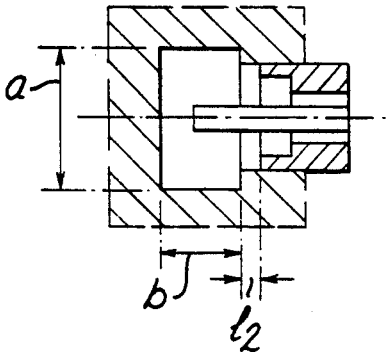
Figure 13A:
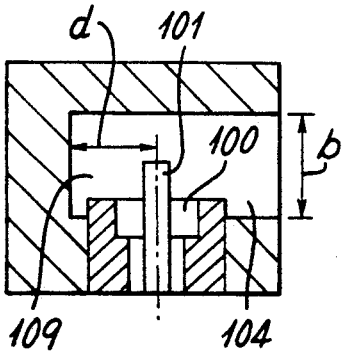
Figure 13B:
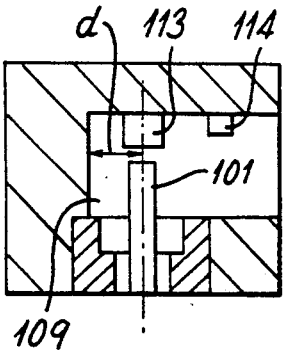
Figure 13C:
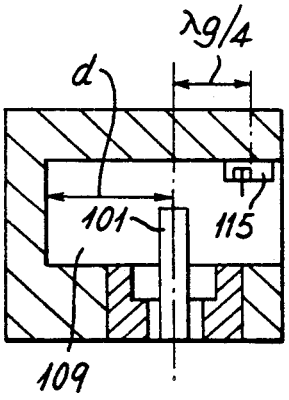
Figure 14A:
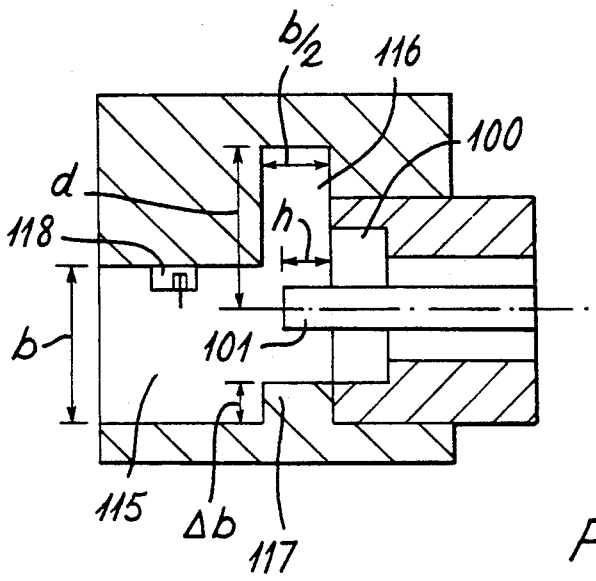
Figure 14B:
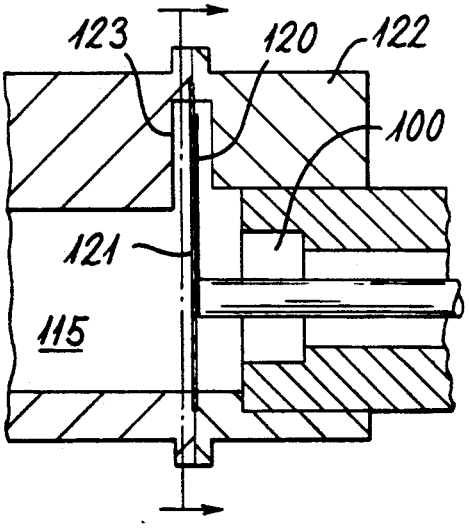
Figure 14C:
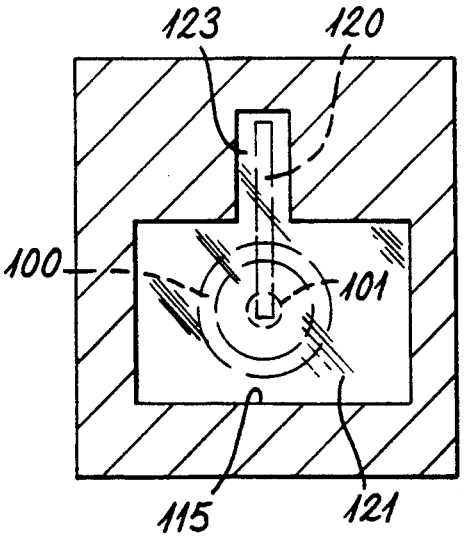
Figure 15:
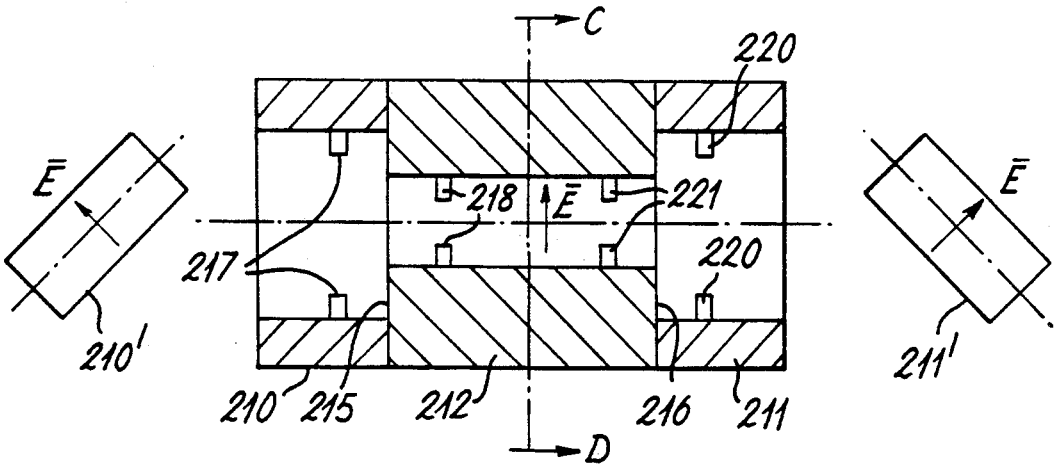
Figure 16A:
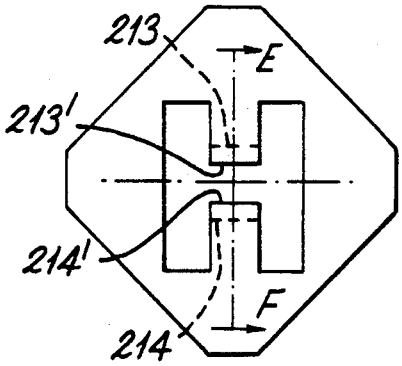

FIG. 9 is a cross-section of a monopole according to the invention matched with a reduced quarterwave transformer, FIG. 10 is a cross-section of a monopole according to the invention matched with "internal" and "external" reduced quarterwave transformers, FIGS. 11*a*, 11*b*, 12*a* and 12*b* show how a monopole according to the invention can be used with a reduced quarterwave transformer to match a coaxial line to various types of symmetrical waveguide, FIGS. 13*a* to 13*c* show a coaxial line matched in various ways according to the invention at the end of a rectangular waveguide, FIGS. 14*a*, 14*b* and 14*c* show end-launch coaxial lines matched according to the invention to rectangular waveguides, FIG. 15 shows a comparatively long twist used in explaining the application of twists to the invention, FIG. 16*a* shows one embodiment of a twist according to the invention (FIG. 16*a* also illustrates the cross-section of the twist of FIG. 15 along the line C-D).

Figure 16B:
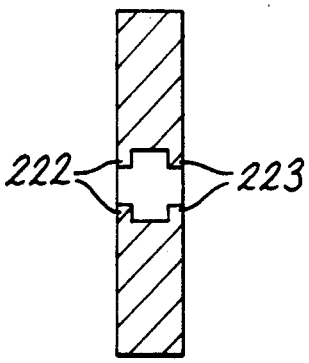
Figure 17:
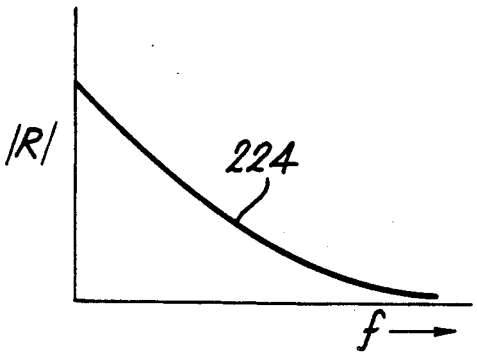
Figure 18A:
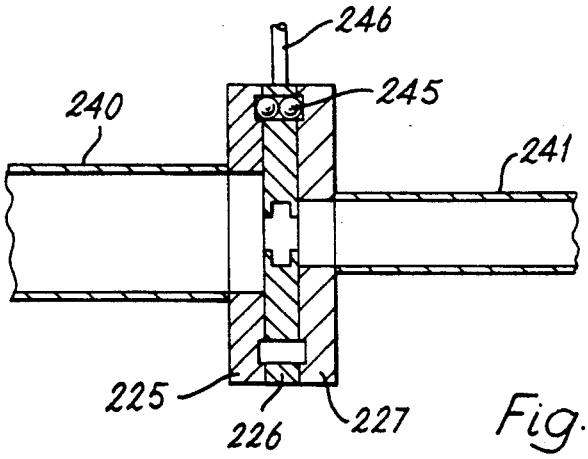
Figure 18B:
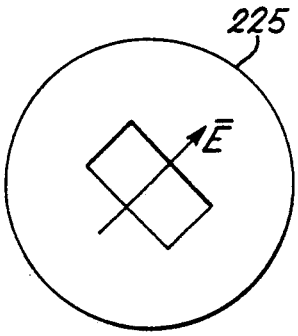
Figure 18C:
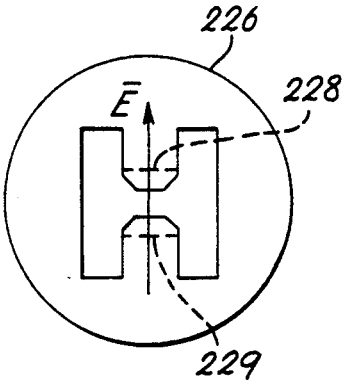
Figure 18D:
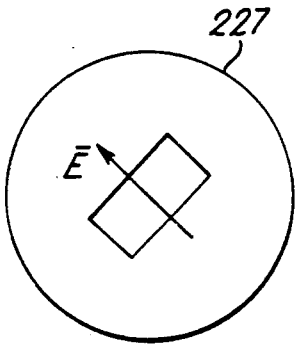
Figure 18E:
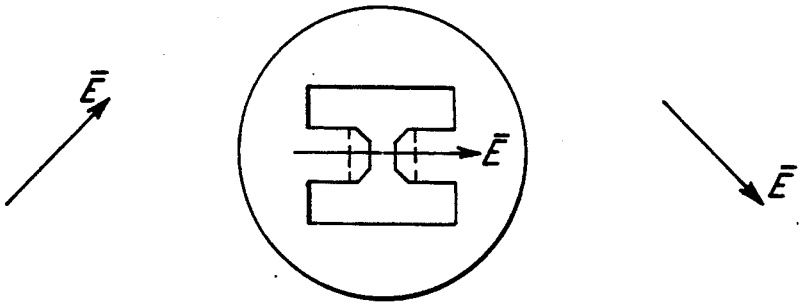
Figure 19:
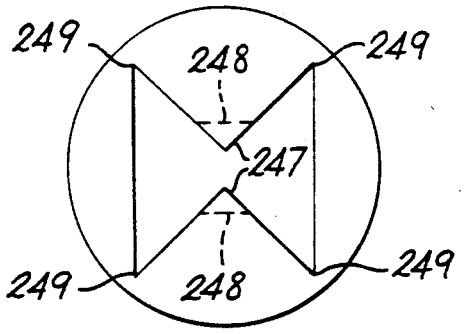
Figures 20A, 20B, 20C:
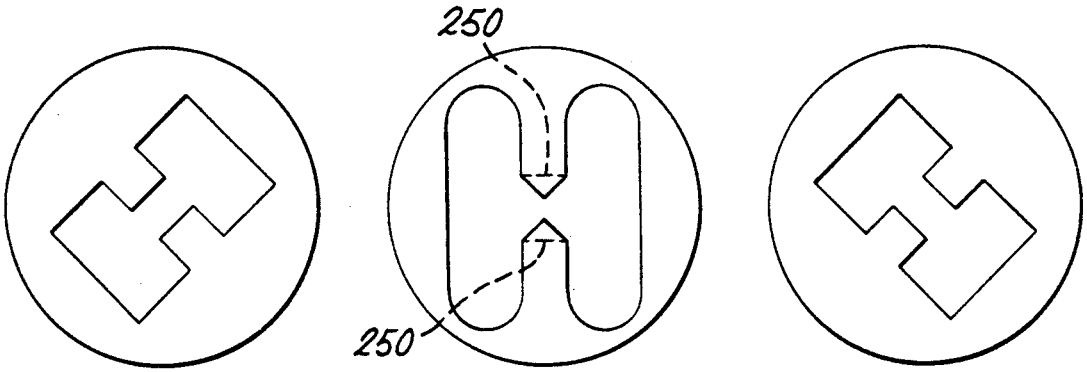
Figures 21A, 21B, 21C:
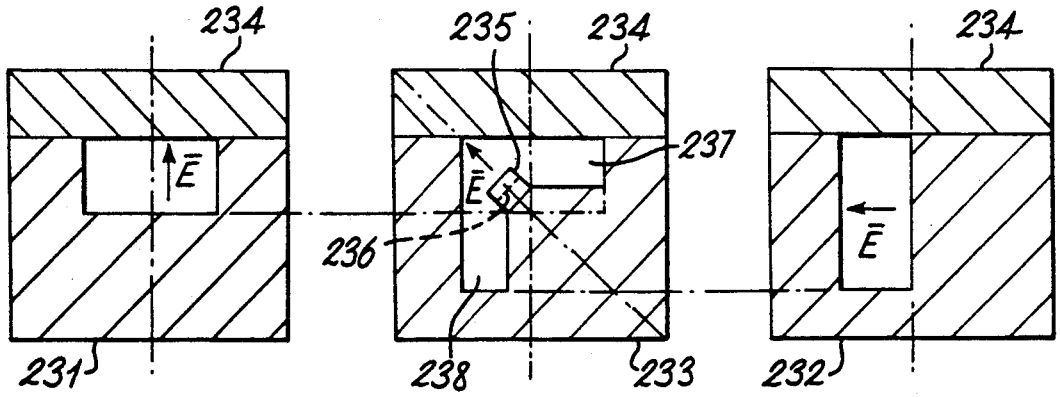
Figure 22:
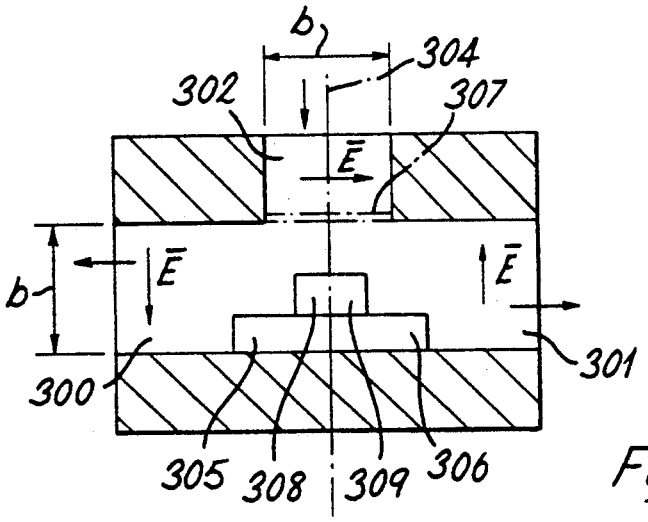
Figure 23:
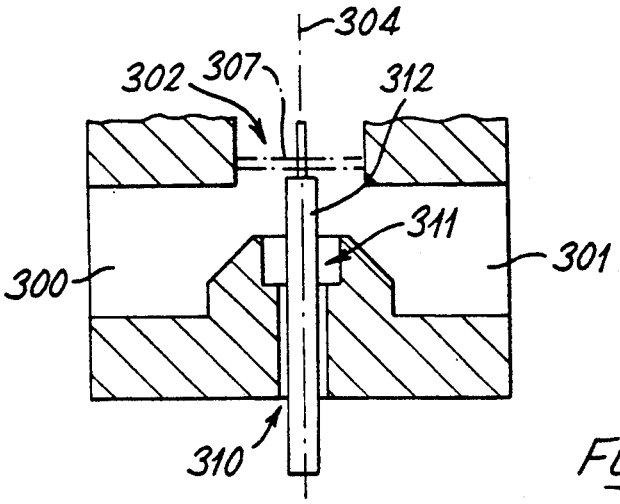
Figure 24:
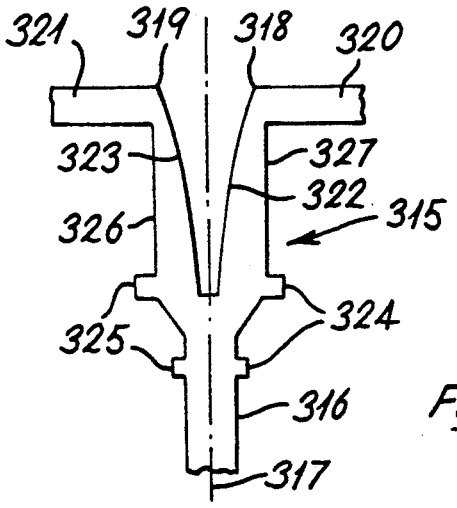
Figure 25B:
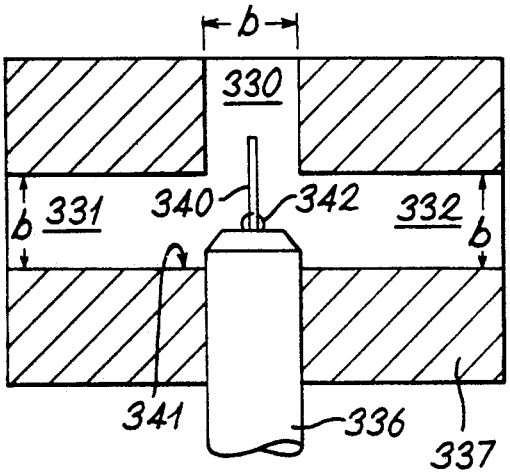
Figure 25A:
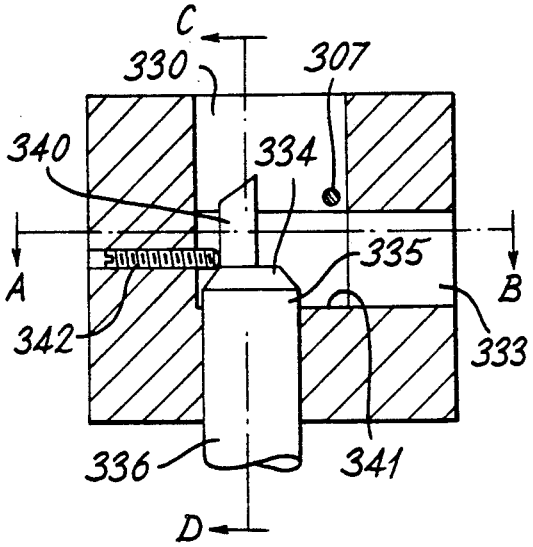
Figure 25C:
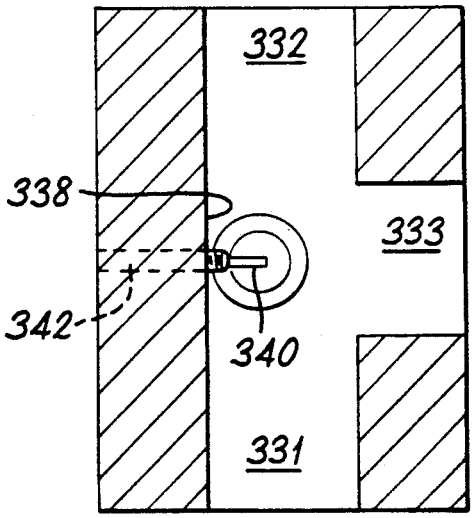

FIG. 16*b* shows a cross-section along the line E-F of the two ridges of FIG. 16*a*, FIG. 17 is a graph of the reflection coefficient versus frequency of the twist of FIG. 16 without matching provided by capacitive projections shown, FIG. 18*a* shows a partial cross-section of another embodiment of a twist according to the invention, FIGS. 18*b* and 18*d* show two end waveguide sections and FIGS. 18*c* and 18*e* show an intermediate section of the twist of FIG. 18*a* in two different angular positions, FIG. 19 shows the cross-section of another twist according to the invention, FIGS. 20*a* and 20*c* show the cross-sections of ridge waveguides which can be coupled by a twist according to the invention having a cross-section shown in FIG. 20*b*, FIGS. 21*a* and 21*c* show the cross-sections of two further waveguides and FIG. 21*b* shows the cross-section of another twist according to the invention for coupling these waveguides, FIG. 22 shows a matched E-plane tee according to the invention, FIG. 23 shows a magic tee according to the invention, with a matched coaxial port, FIG. 24 shows a matched strip line tee according to the invention, FIGS. 25*a*, 25*b* and 25*c* are cross-sections of a magic tee with four waveguide ports according to the invention.

Figure 26A:
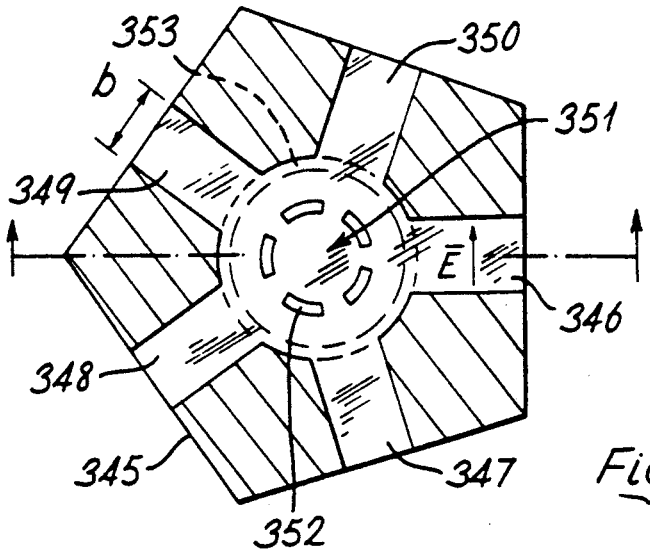
Figure 26B:
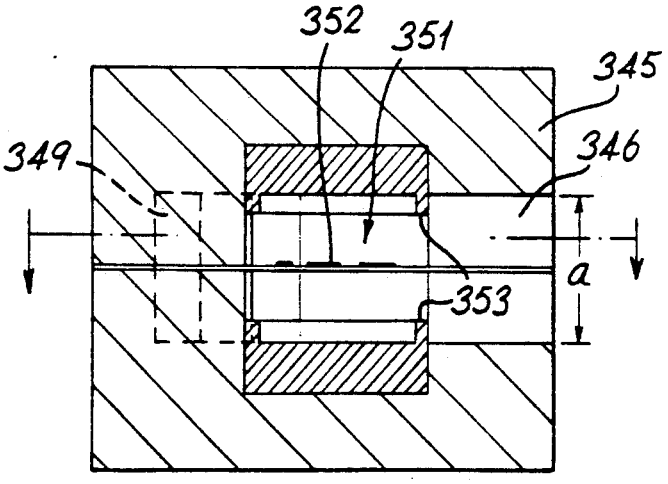
Figure 27:
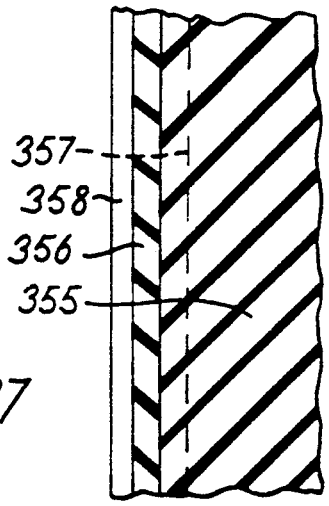

FIGS. 26*a* and 26*b* are cross-sections of a matched symmetrical waveguide five-port junction according to the invention, and FIG. 27 is a cross-section of an air/dielectric interface matched according to the invention.

In FIG. 1 a waveguide section 10 shown in longitudinal section is of constant width but contains a step 11 between a comparatively low height portion 12 and a comparatively greater height portion 13. As will be explained, the reflection coefficient of the step 11 referred to a reference plane 14 is compensated over a whole waveguide band (for example 8.2–12.4 GHz) by the vectorial sum of the reflection coefficients of a shunt inductive element 16 in the reduced height portion 12 and a shunt capacitive element 17 in the portion 13 (referred to the plane 14).

The reflection coefficient of the step 11 without the compensating elements 16 and 17 has a relatively high value and is constant over the X band from 8.2 to 12.4 GHz. It can be shown by theory and experiment that a reference plane for the step can be found in which $$R_- = -R_+$$

where $R_-$ and $R_+$ are the reflection coefficients for positive and negative directions of transmission, respectively, as indicated in FIG. 1. The reference plane p varies in position and its position depends on the magnitude of $R_-$ and $R_+$ and on frequency. FIG. 2*a* shows this variation, with frequency plotted against the distance AP between the step and the reference plane, for various values of reflection coefficient (0.1 to 0.5) which depend on step size. The values shown are reduced if the height b of the portion 13 is reduced but in any case it will be seen that the variation in the position of the reference plane is small over the X-band. The change amounts to less than half a millimeter in comparison with the guide wavelength of 30 to 60 millimeters.

FIG. 2*b* shows the change in phase of the reflection coefficients $R_{A+}$ (reflection from the step 11 at plane A seen from 13) and $R_{A-}$ (reflection coefficient from the step 11 at plane A seen from 12) with distance from the step 11. As this distance is increased into the portion 13 the angles $\phi$ vary in the direction of the arrows in FIG. 2*b*, and when $\phi$ becomes equal to $2\beta AP$ so that $R_A$ approaches R. the reflection coefficients ($R_+$ and $R_-$) are those at the reference plane and therefore equal and opposite (where $\beta$ is the phase constant of the waveguide portion 13).

An inductive element connected in shunt across a transmission line terminated in its characteristic impedance (Zo) has a reflection coefficient $R_L$ at the point where it is connected given approximately by $$R_L = j\frac{Z_o}{2}\ \frac{1}{\omega L}$$

where $j=\sqrt{-1}$, $\omega$=angular frequency, and

L=the inductance of the inductive element.

$R_L$ is plotted at 20 on FIG. 2*c*. The horizontal axis shows frequency across a band considered from a low frequency $f_L$ to a high frequency $f_H$ and the vertical axis shows reactance and an imaginary value jA equal to $$j\frac{Z_o}{2}\ \frac{1}{\omega_O L}.$$

($\omega_0$ is the angular frequency corresponding to a frequency $f_0$ mentioned below.) A similar curve 21 is shown for the reflection coefficient of a shunt connected capacitive element connected across a line terminated by its characteristic impedance. The reflection coefficient $R_C$ at the point where the element is connected is $$R_C = -j\frac{Z_o\omega C}{2}$$

where C is indicative of capacitance of the capacitive element. The two variations 20 and 21 cross at a frequency designated $f_0$ and if variations $\epsilon=\Delta f/f_0$ are considered then $$R_L = j\,A(1-\epsilon), \text{ and}$$

$$R_C = -j\,A(1+\epsilon),$$

where $$A = \frac{Z_o}{2\omega_O L} = \frac{Z_o}{2}\,\omega_O C$$

When $R_L$ and $R_C$ are transferred to the reference plane 14 their vectorial sum is substantially constant and for this reason can be used to compensate for the reflection coefficient of the step of FIG. 1. This is in contrast to any attempt to match a step by a component whose reactance and therefore its reflection coefficient varies with frequency.

Since the reflection coefficients of the shunt inductance and shunt capacitance elements are almost purely reactive, these elements must be positioned so that when transferred to the reference plane the vectorial sum of their reflection coefficients becomes substantially real (and of course in the right sense to cancel the reflection coefficient of the impedance step). Thus the inductive and capacitive elements are positioned at substantially one eighth of a guide wavelength in the waveguide band from the reference plane on either side thereof so that the vectorial sum of their reflection coefficients becomes substantially real at the reference plane.

FIG. 2*d* shows the position of the inductive and capacitive elements relative to the reference plane 14 and FIG. 2*e* shows vectors $R_L$ and $R_C$ representing the reflection coefficients of the inductive and capacitive elements respectively transferred to the reference plane. Also shown are vectors $R_{LC}$ and $R_{CL}$ representing the vectorial sums of $R_L$ and $R_C$ in the reference plane for directions from inductance element to capacitance element, and vice versa, respectively.

For the correct sign of reflection coefficients for cancellation of the reflection coefficient of the step, the shunt inductive and shunt capacitive elements 16 and 17 are positioned, as shown, in the low and high waveguide portions 12 and 13, respectively.

Since the magnitude of the reflection of the reactance of the inductive and capacitive elements varies with frequency, the position of the reference plane of their combined reflections coincides with the reference plane of the step and also varies slightly with frequency. If in FIG. 2*d* the two elements are spaced by a distance d approximately equal to a quarter of the guide wavelength for the band and the distances of the inductive and capacitive elements from the reference plane 14 are $d_L$ and $d_C$, respectively, then $d_L$ and $d_C$ can be written as $$d_L = \frac{d}{2}(1 + \delta), \text{ and}$$

$$d_C = \frac{d}{2}(1 - \delta);$$

where $\delta$ is much less than one and represents the variation in the distance of the reference plane with frequency from the position half-way between the elements.

It can be shown that $R_{LC} = -R_{CL}$ if $$-\epsilon = \tan \beta d \tan \delta\beta d$$

where $\beta$ is the phase constant equal to $2\pi/\lambda g$. Thus a relationship is established between frequency variation ($\epsilon$) and reference plane position ($\delta$). and this relationship can be used to ensure that the variation in the position of the reference plane for the combination of the inductive and capacitive elements matches that of the step (shown by way of example in FIG. 2*a*).

For the magnitude of the reflection coefficient due to the inductive and capacitive elements:

$$R_{LC} = -\frac{2A \sin \beta d}{\cos \delta\beta d}$$

which can be made almost constant over the band, if A is made slightly frequency dependent by choosing appropriate inductive and capacitive elements.

Tests have shown excellent matching ($|R| \leqq 0.02$) over the X-band from 8.2 to 12.4 GHz for the waveguide shown in FIG. 1 with b=10.15 millimeters and the distances of the inductive and capacitive elements from the step being 3 and 5.5 millimeters respectively, for steps which give (in the absence of compensating components) reflection coefficients in the range 0.1 to 0.5.

Another step may be used so that the position of the combined reference plane of the two steps varies with frequency provided the steps have unequal reflections. Full-band matching can then be achieved with one matching element (inductive or capacitive) only. This is an important feature for planar circuits (for example stripline or microstrip). Further with reflection coefficients above 0.5, matching becomes more difficult and the double step plus capacitive matching elements shown in FIG. 3 is a better alternative. In this figure an intermediate height waveguide portion 23 is positioned between the two portions 12 and 13 and there are now two steps 24 and 25 and a single compensating arrangement formed by two spaced capacitive elements 26 and 27 positioned in the portion 13.

Double step arrangements are already known for reducing the reflection coefficient which occurs when transition between different height waveguides occurs. Two steps with equal reflection-coefficients, spaced by a quarter wavelength, are usual and the arrangement is known as a quarterwave transformer. The modulus of the reflection coefficient of the arrangement is considerably reduced but it is zero at only one frequency. It can be shown that if the reflection coefficients at the reference planes 28 and 29 for the steps 24 and 25, respectively, are referred to a reference plane 30 for the double step arrangement (that is a plane at which the vectorial sum of the reflection coefficients of the two steps for one direction of transmission is equal and opposite to that for the other direction of transmission) then the value of this reflection coefficient $R_{T-}$ varies as shown in FIG. 4*a*. Such a variation with frequency is difficult to compensate in view of its change of sign at the frequency $f_0$.

This problem can be overcome by making the distance between the steps 24 and 25 a quarter of a guide wavelength at a frequency above the band of interest, not a quarter of the guide wavelength within the band for which the waveguide is designed as in conventional quarterwave transformers. As a result the variation in $R_{T-}$ is now as shown at 32 and 33 in FIG. 4*b* for two different conditions which will be explained later. Such a variation can be compensated by the double capacitive element 26, 27 in which the two elements are separated by a quarter of a wavelength at a frequency which is greater than $f_H$.

Although it is preferable for matching purposes for these step reflections to be different, a reflection coefficient which changes in magnitude over the whole frequency range of the waveguide is also obtained with equal step reflections.

With equal step reflections as used in conventional quarterwave transformers, $$PR = \frac{d'}{2}(1 + \delta'), \text{ and}$$

$$QR = \frac{d'}{2}(1 - \delta'),$$

where

PR and QR are the distances between the reference planes (P and Q) for the steps 24 and 25 and the combined reference plane (R) for both steps, respectively, d' is the distance between the planes P and Q, and $\delta'$ represents the frequency dependent variation in the distance of the plane R from the mid-position between the planes P and Q.

The variation $$\frac{d'}{2}\delta'$$

of the position of the reference plane 30 from the mid-point between the two reference planes P and of the steps 24 and 25, for both steps taken together, varies only slightly with frequency due to the minor variations of the positions of the reference planes of the steps. However the present inventor has realised that by introducing a variation in step reflection, the position of the plane 30 can be made to change more with frequency. Consider $\gamma$ as the change in reflection coefficient due to difference in relative step size so that $$R_1 = R_0(1-\gamma), \text{ and}$$

$$R_2 = R_0(1+\gamma)$$

where $R_1$ and $R_2$ are the reflection coefficients of the steps referred to the planes 28 and 29, respectively, and $R_0$ is the reflection coefficient of both steps at these planes when the step reflections are equal. The line 32 in FIG. 4*b* is for $\gamma>0$ and the line 33 is for $\gamma=0$. It can be shown that the position of the reference plane is given by $$\tan \delta'\beta d' = \gamma \tan \beta d',$$

where $d' = \lambda go/4$ $(=PQ)$

This relationship provides a relationship between $\delta'$ and $\gamma$ and enables graphs such as those shown in FIG. 4*c* to be plotted. When $\gamma=0$ there is no variation in position of the reference plane 30 but as $\gamma$ is increased variation occurs and this variation is matched to variation of the reference plane for the capacitive elements 26 and 27 so that the reference plane 30 the combined reflection coefficient of the two steps 24 and 25 is equal and opposite to the reflection coefficient due to the capacitive elements 26 and 27, over a whole waveguide band.

Since the line 32 (FIG. 4*b*) reaches zero at a frequency $f_1$ above $f_0$ which is above $f_H$, the distance between the steps is less than a quarter wavelength at the centre band frequency, in contrast to the conventional arrangement. The result is a "reduced quaterwave" transformer and since the line 33 corresponds to equal steps such a transformer may have equal steps.

Table 1 below gives dimensions of various examples of the arrangement of FIG. 3 with calculated values of $\gamma$ where the height of the portion 13 is 10.15 millimeters, the height of the portion 23 is $b_1$ and the height of the portion 12 is $b_0$. In addition the distance AB is the length of the portion 23 and BC is the distance from the step 25 to a point half-way between the capacitive elements 26 and 27.

TABLE 1

| $b_0$ | $b_1$ | $\gamma$ | AB | BC | mm |
|---|---|---|---|---|---|
| 7 | 8 | 0.28 | 6.5 | 4 | |
| 6 | 7.5 | 0.15 | " | " | |
| 5 | 6.7 | 0.12 | 6 | 4.5 | |
| 3.3 | 5.5 | 0.07 | " | 4 | |

It will be realised that an important feature of these examples is that matching over a full waveguide band is achieved using a shunt capacitive element and without an inductive element.

The overall length of a matched transition is about the same as a conventional quarterwave transformer but the matching provided is much improved and again the modulus of the overall reflection coefficient can be below 0.02 over the band 8.2 to 12.4 GHz.

The principle of matching a transition using only one reactive element can also be used for mode converters, for example in the way shown in FIG. 5 where a shunt inductance matching element is used. As in FIG. 3 the waveguide transition itself is a "reduced quarterwave transformer" with a matching element on one side only. Broadband matching is achieved by ensuring that the reference plane of this transformer remains at a distance of one eighth of the guide wavelength from the matching element. The reflection coefficient of the unmatched transition is equal and opposite to the reflection coefficient at the reference plane of the matching element and this equality is maintained with any change in reflection coefficient of the transition with frequency.

Figure 5A:
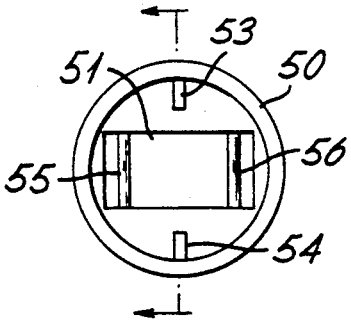
Figure 5B:
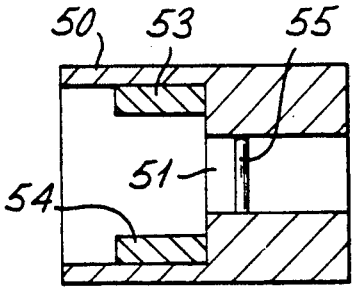

FIGS. 5*a* and 5*b* show a cross-section and a longitudinal section, respectively, of a transition from a circular waveguide to a rectangular waveguide. In FIG. 5*a* the view shown is into the circular waveguide 50 towards a rectangular waveguide 51. The circular waveguide contains a reduced $\lambda/4$ section formed by the two conductive plates 53 and 54 and the rectangular waveguide contains an inductive matching element consisting of two posts 55 and 56. In an example the gap between the plates 53 and 54 is 16 millimeters, the rectangular waveguide is 22.9 by 10.2 millimeters, the length of the reduced $\lambda/4$ section is 8 millimeters and the distance of the elements 55 and 56 into the rectangular waveguide from the transition is 3 millimeters. The diameter of the circular waveguide is 25 millimeters.

Figure 5C:
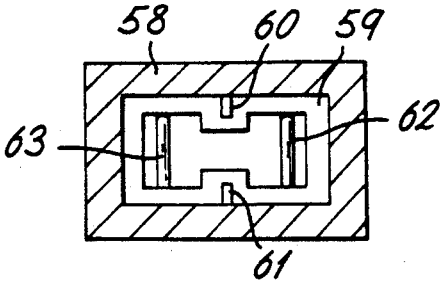
Figure 5D:
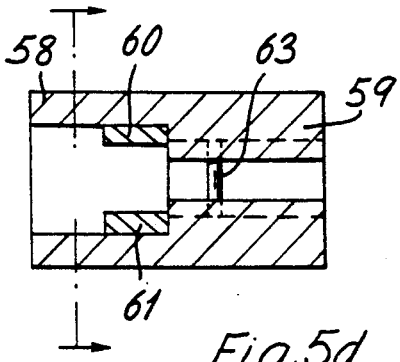
Figure 5E:
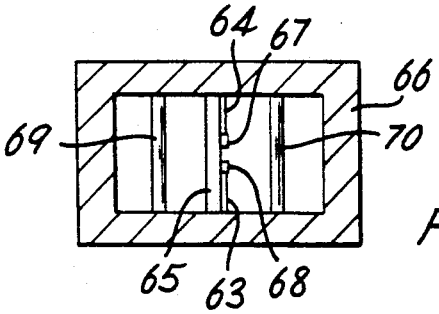

FIGS. 5*c* and 5*d* show a rectangular to ridge waveguide transition matched according to the invention. Looking through a rectangular waveguide 5B in FIG. 5*c* the ridge waveguide 59 can be seen starting at the transition. Two fins 60 and 61 are positioned inside the rectangular waveguide 5B and form the reduced $\lambda/4$ section, and two inductive posts 62 and 63 are positioned in the ridge waveguide 59. FIG. 5*e* shows a transition (which has a similar longitudinal section as shown in FIG. 5*d*) from a fin line formed by conductive areas 63 and 64 mounted on a dielectric layer 65 to a rectangular waveguide 66. Matching is carried out according to the invention by using fins 67 and 68 to form the reduced $\lambda/4$ section and inductive posts 69 and 70 positioned in the rectangular waveguide as the only matching element.

Figure 5F:
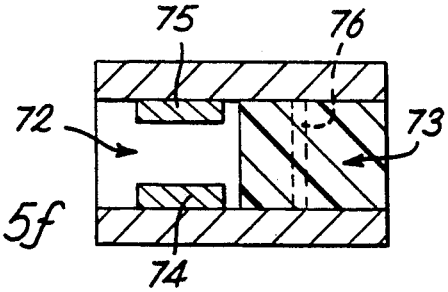
Figure 5G:
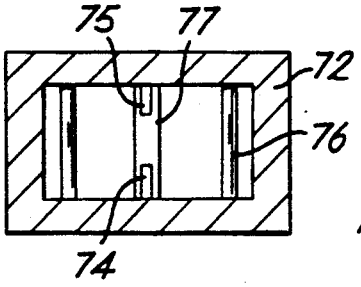

FIG. 5*f* shows a transition from an air filled rectangular waveguide 72 to a waveguide 73 filled with dielectric. Matching is according to the invention using fins 74 and 75, forming the reduced $\lambda/4$ section and two inductive posts, one of which is shown at 76 in the waveguide 73 both at the same distance from the transition but adjacent to opposite sides of the waveguide 73. A somewhat similar arrangement is shown in FIG. 5*g* where the waveguide 72 is only partially filled with dielectric by means of a longitudinal dielectric plate 77.

Where differences in height between the waveguides at the discontinuity are great, then any step near the small waveguide tends to be critical in design and for this reason tapers such as those shown in FIG. 6 can be used. In FIG. 6*a* the portion between the steps 24 and 25 is now designated 31 and has a constant radius taper in its upper surface only. The taper has little effect on the position of the reference plane for the steps 24 and 25 and as before the distance between these steps is based on a quarter wavelength at a frequency a little above the band of interest. The capacitive elements 26 and 27 compensate for the reflection coefficient at the reference plane of the two steps in the same way as described for FIG. 3. A constant radius taper is used rather than a linear taper or an exponential taper because a constant-radius taper has a reference plane which moves increasingly with increase in frequency and helps to provide a combined reference plane R for the taper and steps which moves in a way which can be compensated by the combined reference plane $R_c$ of the capacitive elements 26 and 27, these planes being approximately one eighth of the guide wavelength apart for the whole waveguide band.

Figure 6A:
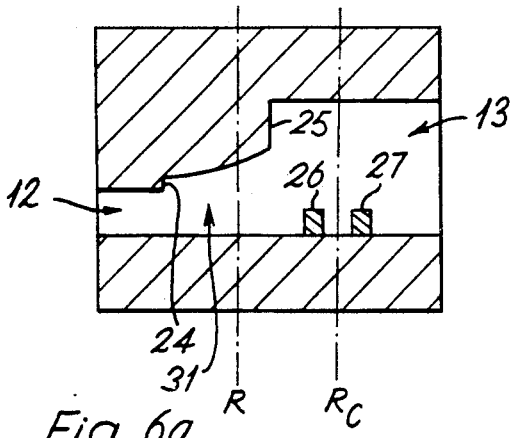

In one example of the waveguide section shown in FIG. 6*a*, a waveguide portion 12 has a height of 3.3 millimeters, the height of the portion 31 at the step 24 is 4.6 millimeters, its height at the step 25 is 6.8 millimeters and the height of the portion 13 is as before 10.15 millimeters. Also the length of the portion 31 is 7.4 millimeters and the distance between the step 25 and the centre point between the elements 26 and 27 is 3.5 millimeters.

Figure 6B:
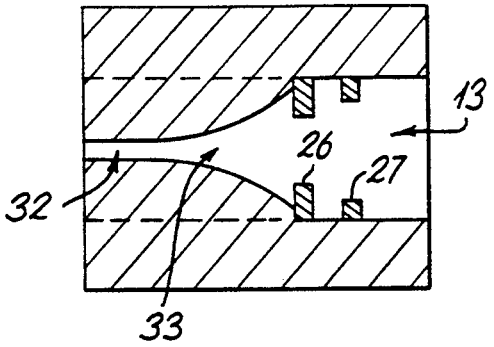
Figure 6C:
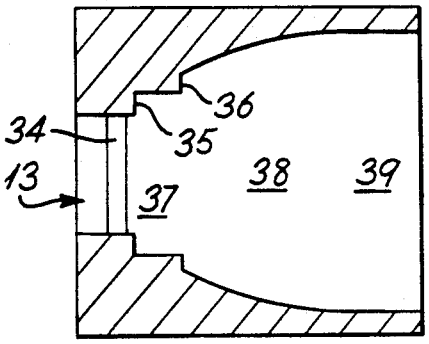

A somewhat similar arrangement is shown in FIG. 6*b* except that the waveguide portions 12 and 31 are replaced by corresponding portions 32 and 33 of a fin line (that is a rectangular waveguide bisected parallel to the dimension b by narrow fins separated by a small gap). The fins in the portion 33 are of constant radius and matching is again achieved by capacitive elements 26 and 27 only. The fins are tangential to the longitudinal axis of the waveguide at the junction of the portions 32 and 33 to prevent reflection at this critical point. In an example the waveguide portion 13 has the same height as previously (that is 10.15 millimeters), the gap between the fins in the section 32 is 0.25 millimeters, the length of the section 33 is 8 millimeters and the distance from the end of the fins to the centre point between the elements 26 and 27 is 3 millimeters.

Where a transition to a square section waveguide is required such as in FIG. 6*c* it is preferable to ensure that no matching elements occur in the wide section waveguide where they could excite higher order modes which can propagate. Thus in FIG. 6*c* the normal X-band rectangular waveguide portion 13 with a height of 10.15 millimeters undergoes transition to a square section waveguide of height and width "a" equal to the normal width of an X-band guide. Since the portion 13 is below cut-off an inductive matching element 34 can be included without its dimensions and position being at all critical with respect to the excitation of higher order modes. Two steps 35 and 36 are then provided giving an intermediate portion 37 and then a constant radius concave taper section 38 occurs with tapers on top and bottom faces. Finally the section 38 joins the required constant dimension square section portion 39 tangentially to prevent reflection. By not having a step at the junction of the portions 38 and 39, problems with critical dimensions likely to excite propagating higher modes at this high impedance portion are avoided. The tapered section 38 is dimensioned to have a very low reflection coefficient (although significant at the lower frequencies) as is known for such tapers. The steps 35 and 36 and the taper are matched in the way described in connection with FIG. 3. The inductive element 34 now compensates for the total reflection coefficient. In addition the steps and the taper are so dimensioned that the reference plane of the combination of the steps and the taper is always one eighth of the guide wavelength away from the inductive element 34. In one example the height of the portion 37 was 13.6 millimeters, the distance of the inductive element from the step 35 was 2 millimeters, the length of the portion 37 was 4 millimeters and the length of the portion 38 was 7.6 millimeters. Only a single inductive element is required because the slope of such an inductive element (see the line 20 in FIG. 2*c* ) is as required to compensate for a two step arrangement (see FIG. 4*b*.)

Figure 6D:
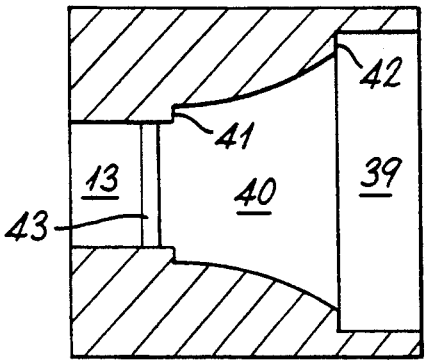

A transition from rectangular to circular waveguide is shown in FIG. 6*d* where a constant-width constant-radius tapered portion 40 is positioned between two steps 41 and 42 and the reflection coefficient due to these steps and the taper at a combined reference plane is compensated only by an inductive element 43. In an example the section 39 has a diameter of 25 millimeters, the section 40 tapers from 22 millimeters to 13 millimeters with a constant width of 22.9 millimeters, inductive element 43 is 0.5 of a millimeter from the step 41 and the section 40 is 10 millimeters in length.

The invention can be applied to most types of transmission line including in addition to the many forms of waveguide the following, for example: strip line, microstrip, coplanar line, slot line, coaxial line, two-wire line and optical waveguide. Where two-wire line or coaxial line is used the capacitive and inductive elements will often be in discrete component form.

All the embodiments described above employ shunt matching elements but the invention can also be put into practice using series matching elements rather than shunt elements and where two elements are required, any combination of series or shunt elements can be used. For example FIG. 7 shows a plan view of a portion of microstrip 90 having a step 91 full-band matched by a series capacitive element 92 and a series inductive element 93, each spaced from the reference plane 94 of the step by one eighth of the guide wavelength at the centre of the band of operation. In addition to the conductors shown the microstrip consists, as is usual, of a dielectric layer 95 separating the conductors shown from a ground plane conductor 96. The design of the microstrip step of FIG. 7 follows the same principles as that of FIG. 1.

As mentioned above the invention may also be applied to matching a quarterwave monopole antenna to a coaxial line.

From experimental data it can be deduced that the real component $R_M(\omega)$ of the impedance of a probe of height h (see FIG. 9) projecting at right angles from a conductive ground plane can be approximated by $$R_M(\omega)=R_o \tan^2 \beta h/2$$

where $R_o$ is the impedance at the resonant frequency of the probe (the probe can be considered as a series combination of a resistance, capacitance and inductance) and B is the phase constant seen from the point where the probe joins the coaxial line. The real component $R_M(\omega)$ is shown plotted against frequency in FIG. 8*a*, where $f_O$ indicates the resonant frequency of the probe and $f_L$ and $f_H$ indicate the low and high extremes of a band of frequencies over which the probe is to be matched to a coaxial line.

Experimental data also shows that the imaginary part $X_M$ of the impedance of the probe viewed from the point where it enters the coaxial line may be represented by $$X_M(\beta h/2)=X_0-X_{max} \sin 2\beta h$$

where $X_0$ is the reactance of the probe at $f_0$, and $X_{max}$ is the maximum reactance of the probe as it varies with frequency.

$X_M$ is zero for $h \simeq 0.23\lambda$, so $X_0$ equals $X_{max} \sin 2\beta h$ for this value of $\beta h$. $X_M$ is zero at resonant frequency of the probes and $X_{max}$ is a maximum value which is reached just above $f_H$. The imaginary part $X_M$ of the impedance is a linear function of frequency near the resonance of the probe and changes sign as it passes through resonance.

A reduced quarterwave transformer similar to the double step of FIG. 3 but for a coaxial transmission line is shown at 100 in FIG. 9 in the form of a length of coaxial line having a length $l_1$ significantly less than a quarter of the guide wavelength at the centre of the band. A probe 101 which projects from a conductive ground plane 102 is connected to a coaxial line 103, the probe having a height h above the ground plane.

Seen from the point where the probe enters the ground plane the arrangement of FIG. 9 can be considered as a length of coaxial line $l_1$ of characteristic impedance terminated by the characteristic impedance $Z_0$ of the coaxial line 103. Looking into the reduced quarterwave transformer 100 from the probe end the real ($R_i$) and imaginary ($X_i$) parts of the impedance seen al-e given by $$\frac{R_i}{Z_0} = \frac{1 + \mathrm{Tan}^2\beta_1 l_1}{1 + (Z_0/Z_1)^2\,\mathrm{Tan}^2\beta_1 l_1}, \text{ and}$$

$$\frac{X_i}{Z_0} = [(Z_1/Z_0) - (Z_0/Z_1)]\frac{\mathrm{Tan}\ \beta_1 l_1}{1 + (Z_0/Z_1)^2\,\mathrm{Tan}^2\beta_1 l_1}$$

For $Z_1=71$ ohms, $l_1=3.5$ mm and $Z_0=50$ ohms these become:

$$\frac{R_i}{Z_0} = 1 + \frac{2\,\mathrm{Tan}^2\phi/2}{1 + \mathrm{Tan}^4\phi/2} \qquad \text{equation 1}$$

$$\frac{X_i}{Z_0} = \frac{0.72\,\sin 2\phi}{1 + \cos^2\phi} \qquad \text{equation 2}$$

where $\phi=\beta_1 l_1$

The length for $l_1$ is approximately one-eighth of the line wavelength at $f_H$ for the X band; that is the quarterwave transformer 100 is a quarter of a guide wavelength long at a frequency above the band of operation.

The real ($R_i$) and imaginary ($X_i$) parts of the imoedance looking into this reduced quarterwave transformer towards the coaxial line and given by equations 1 and 2 above are plotted in FIG. 8*b* where they can be seen to be similar to those of the probe 101 shown in FIG. 8*a*. The values of $R_i$ and $X_i$ have to be optimised to give a perfect match over the whole frequency band from $f_L$ to $f_H$ and this is equivalent to finding the reference plane of the quarterwave transformer 100 and arranging for its reflection coefficient to be equal and opposite to the reflection coefficient due to the probe 101 at the reference plane over the whole working band.

As is usual in microwaves optimisation of h, $l_1$, and the diameter $2B_1$ of the reduced quarterwave transformer 100 based on measurements of prototypes is likely to be necessary in many applications to achieve good full-band matching.

For the X band, full-band matching for a 50 ohm coaxial line 103 is given by the following values:

$Z_1=71$ ohms, $l_1=3.5$ mm, the radius of the transformer 100 $2B_1=9.8$ mm and the inner and outer diameters of the coaxial line are 3 and 7 mm, respectively for h equal to approximately 8 mm.

In order to simplify matching, the arrangement of FIG. 10 may be used. Here the reduced coaxial quarterwave transformer 100 is combined with a reduced radial quarterwave transformer 104 formed as a step of height $l_2$ in the ground plane between the level 102 and a level 105. There are now four independent parameters for matching the impedance of the probe ($R_M(\omega)$ and $X_M(\omega)$) over the whole band. These independent parameters are $l_1$ and ($B_2$-b) (the electrical lengths of transformers 100 and 104), respectively, and $Z_1$ and $Z_2$ the characteristic impedances of the transformers 100 and 104, respectively. $B_2$-b is the electrical length of the transformer 104 because this is the dimension which is measured along the path of a wave radiated from the probe.

With the other dimensions as given for FIG. 9 above, the diameter of the step in the ground plane of FIG. 10 is 15 mm and the length $l_2$ is 2 mm for X band.

The full-band matched monopole described above can be used to match a coaxial line to many types of waveguides, (see FIGS. 11 to 14 for example) in addition to its uses as an antenna, as such.

Placing an electrically conducting top plane 106 parallel to the ground plane and over the monopole, as shown in FIG. 11*a*, does not make much change in the electric fields around the monopole since it is at right angles to the electric field. The result is a radial waveguide with an impedance as seen looking from the probe into the waveguide which changes as the distance H between the ground plane 105 and the top plane 106 approaches half the guide wavelength. If $l_1$, $Z_1$ and $l_2$, $Z_2$ are optimised then a voltage standing wave ratio (V.S.W.R.)≃1.02 can be approached. However if the top of the probe is near to the top plane 106 a blind hole 107 which reduces capacity at the top of the probe is useful. Nevertheless a capacitance with a reflection coefficient which peaks at the high end of the working band is also useful, for matching, and is provided by a capacitive probe 108.

The radial electric field of the $TM_{01}$ mode can be excited in a circular waveguide by a probe fed from a coaxial line as shown in FIG. 11*b* where the axis of the circular waveguide is an extension of that of the coaxial line. Looking from the circular waveguide into the coaxial line the outer quarter wavelength transformer 104 introduces a high impedance in series with the outer conductor of the coaxial line and thus helps to overcome any matching problems. Only minor changes in dimensions are needed for the two transformers as compared with the monopole for full-band matching with a V.S.W.R.≃1.10. A coaxial line to circular waveguide mode converter of this type can be used as part of an arrangement for exciting the $TE_{01}$ mode in circular waveguides. For example the arrangement shown in U.S. Pat. No. 4,890,117 and U.K Application No. 8801002 (published under the number 2,201,046) (Inventor: F. C. de Ronde) can be modified by replacing the coaxial to waveguide transition shown in FIG. 2*a* therein with a transition according to the present invention.

In FIG. 12*a* the circular waveguide walls of FIG. 11*b* have been replaced by two plane conducting side walls 111 and 112 extending at right angles to the plane of the diagram and symmetrically located in relation to the probe 101. As before the two reduced quarterwave transformers 100 and 110 are used. The "trough" guide formed by the walls 111 and 112 may have a distance "a" between the walls which is of the same dimension as the transverse distance across the corresponding rectangular waveguide and a distance from top to bottom of the trough which is greater than or equal to "a". By closing the top of the trough as in FIG. 12*b* a transition to a rectangular waveguide is provided, and the narrow dimension of the rectangular cross-section formed may be "b", the conventional size for such a waveguide by reducing the dimension which is greater than or equal to "a". By lowering the closing conductor to the dimension b the characteristic impedance of the waveguide is changed by a factor b/a in comparison with the trough guide. For matching, the change can be taken into account by changing the length of the probe h and altering the dimensions of the two transformers; for example by changing the length $l_2$ (FIG. 12*b*) of the transformer which corresponds to the transformer 104 of FIG. 10.

Usually a coaxial line to rectangular waveguide or double ridge waveguide transition is asymmetrical as far as propagation along the waveguide itself is concerned. Conversion from symmetrical to asymmetrical can be achieved by the addition of a short circuiting plunger, for example the symmetrical arrangement of FIG. 12*b* can be converted to the asymmetrical arrangement of FIG. 13*a* by the addition of a short circuit at a distance d from the probe 101. A short circuited section 109 of waveguide results. If d is approximately electrically equal to a quarter of the guide wavelength, the dimensions h, $l_1$, $Z_1$, $l_2$ and $Z_2$ can be so chosen that full-band matching is achieved if d is modified slightly. If the waveguide section 109 is made a quarter guide wavelength long at frequency $f_M$ (that is a frequency in the middle of the working band and approximately equal to 10 GHz for the X band) then reflections are low at $f_L$ and $f_H$. By selecting, by a process of measurement and modification, suitable dimensions for h, $l_1$, $Z_1$, $l_2$ and $Z_2$ a good full-band match with V.S.W.R. better than 1.02 can be obtained.

There are two other methods, illustrated in FIGS. 13*b* and 13*c*, of achieving a full-band match at a coaxial line to rectangular waveguide transition. In FIG. 13*b* the distance d is a quarter of the guide wavelength long at $f_H$ (which equals approximately 12.4 GHz for the X band), when the short circuit waveguide 109 presents a shunt inductance to the monopole over the whole band and the resulting reflections are compensated by a shunt capacitance which varies in the same way with frequency. As in the arrangement of FIG. 3 matching is achieved using two capacitive stubs 113 and 114. Since one stub is near to the probe 101 the distance h may have to be changed.

The other alternative matching method is shown in FIG. 13*c* where the distance d is equal to a quarter of the guide wavelength at the low end of the working band (that is at 8.2 GHz for the X-band). In this arrangement the short circuit waveguide presents a shunt capacitance to the monopole over the whole band and the reflections caused are compensated by a special capacitive stub 115 a quarter of the guide wavelength from the probe 101.

An end-launch coaxial line to waveguide transition for a rectangular waveguide is shown in FIG. 14*a*. Since the probe 101 is perpendicular to the desired electric field in a rectangular waveguide 115 either the probe or the waveguide must include a bend or a corner. Either alternative is viable but in FIG. 14*a* a waveguide corner 116 is shown. With this arrangement the electric field in the corner is parallel to the probe 101 as is required and propagates into the waveguide 115 to give the required electric field in the waveguide. The length "d" of the corner section 116 is a quarter of a guide wavelength at the centre frequency of the band and its height parallel to the probe may be reduced to half the height of the rectangular waveguide (that is b/2). The probe 101 and its reduced quarterwave transformer 100 match the coaxial line to the corner section 116 and in addition the corner is matched in a known way by the small step 117 of height Δb. The frequency dependent influence of the corner section 116 is compensated by a capacitive stub 118 in the same way as for FIG. 13*c*.

In FIG. 14*b* which shows another end-launch coaxial line to waveguide transition a conductive probe 120 is printed on a dielectric substrate 121 (see FIG. 14*c*). The waveguide 115 has an end cap 122 which holds the substrate in place and on which the coaxial line ends. FIG. 14*c* is a view of the cap looking towards the coaxial line with the waveguide removed.

The probe 120 is a thin but rather broad conductor which acts in the same way as the probe 101 in FIG. 13. The current induced in the probe 120 by excitation of the waveguide passes via a 90° corner to the coaxial line, where it sees the same impedance ($R_i$, $X_i$) as the previously mentioned monopole impedance ($R_M$, $X_M$). Thus full-band matching is achieved.

To match the probe 120 to the waveguide it has a length of about a quarter (free-space) wavelength and to accommodate this length it extends into a hole 123, in order to prevent top loading.

Preferably the axis of the inner conductor of the coaxial line is just above the horizontal axis of the waveguide 115 as seen in FIG. 14*b*, and the probe 120 is not connected to the waveguide 115 or end cap 122.

Similar arrangements to those shown in FIGS. 12, 13 and 14 can be made for double ridge waveguides.

In general it may only be necessary to use either the coaxial reduced quarterwave transformer 100 or the radial reduced quarterwave transformer 104. However in practice it is often useful to be able to use both these transformers.

Instead of being in the form of two steps separated by a uniform impedance section, the reduced quarterwave transformers according to the invention, for example those of FIGS. 9 to 14, may be in the form of linear or constant-radius tapers.

Considering now examples of twists, in FIG. 15 a 90° twist has rectangular waveguide sections 210 and 211 separated by a ridge waveguide section 212. Viewed from the left-hand end section 210 appears as shown at 210' and viewed from the other end the section 211 appears as shown at 211'. The cross-section of the section 212 on the line C-D is as shown in FIG. 16*a* except that the tops of the ridges are as indicated by the dotted lines 213 and 214 and the projections indicated by the solid lines 213' and 214' are not present at this-stage. The relative orientation of the sections 210, 211 and 212 is indicated at 210' and 211' in FIG. 15. The relative orientation for the section 212 (along lines C-D) is shown in FIG. 16*A*.

The object of the ridges is to bind the electric field E to the direction which is half-way between the electric field directions of views 210' and 211'. This is achieved by using the narrow gap between the ridges. The fields in the waveguide sections 210 and 211 are able to transfer to the intermediate section 212 without causing a disturbance which cannot be matched.

In FIG. 15, full-band matching of interfaces 215 and 216 between the sections is carried out by the technique described above. Each of these interfaces presents an asymmetrical impedance step combined with a symmetrical reactive discontinuity and the combination is therefore asymmetrical. The impedance step can be matched as indicated in connection with FIG. 1 by a shunt inductance in the section 212 and a shunt capacitance in the appropriate one of sections 210 and 211. However the reactive discontinuity presented by each interface is equivalent to a shunt inductance and is used in full-band matching the impedance step together with the shunt capacitance. Reflection coefficients are made equal and opposite at the reference plane. A series capacitance can be used to match the symmetrical shunt inductance but since series capacitances are difficult to construct a shunt capacitance is used instead. The modulus of the reflection coefficient of a shunt inductance falls with increase in frequency and this is also true for a pair of shunt capacitances making them suitable to give full-band matching. The resulting arrangement is two pairs of projections 217 and 218 forming capacitive stubs to match the interface 215. The capacitance by the projection 217 partially matches both the and the shunt inductance and this capacitance is therefore than that provided by the projection 218. The interface 21 matched in a similar way by the projections 220 and 221.

The of the twist described so far depends on the distance b the capacitive projections 218 and 221 but for very short according to some embodiments of the invention this distance is reduced to zero, when the section 212 can be regarded as diaphragm having a double impedance step. The upper capacitive projections 217 and 218 can be replaced by a single upper projection 222 (see FIG. 16*b* ). Similarly the lower projections 217 and 218 can be replaced by the lower projection 222, and the projections 220 and 221 can be replaced by the projections 223. The reference plane for the diaphragm as a whole is located half-way between the interfaces 215 and 216 and can be matched over the full band by the two pairs of capacitive projections 222 and 223 as shown in FIG. 16*b* and indicated by the dotted lines 213 and 214 and the full lines 213' and 214' in FIG. 16*a*.

By lengthening the uprights of the "H" in FIG. 16*a*, the shunt inductance of the diaphragm is reduced since there is less interference with the magnetic field. The modulus of the reflection coefficient R of the diaphragm falls with frequency as shown at 224 in FIG. 17. If the projections 222 and 223 forming a double capacitive matching element are $\lambda g/4$ apart at a frequency above the band or approximately $\lambda g/8$ at the centre of the band of the twist, where $\lambda g$ is the guide wavelength, then the reflection coefficient of the double capacitances falls with frequency in nearly the same way as that of the diaphragm and can be made approximately equal to (but opposite from) the reflection coefficient 224 of the diaphragm. Thus if the capacitances are arranged to have a reflection coefficient of the required magnitude at the reference plane, then full-band matching is achieved.

A reduced length twist as described above is in a simple form as shown in FIG. 16*b* and appears as in FIG. 16*a* when viewed at right angles to FIG. 16*b*. Such a twist is simply coupled between two waveguides twisted in relation to one another. Since as mentioned above the width of the groove between the projections 222 and 223 need be only $\lambda g/8$, the twist is very short compared with known twists, and is less than a quarter of the minimum guide wavelength in the waveguide band.

An arrangement which allows the polarization of the transmitted wave to be reversed by 180° is shown in FIG. 18*a*. FIGS. 18*b* and 18*d* show coupling flanges 225 and 227 of waveguides 240 and 241 and FIG. 18*c* shows an intermediate section 226 having a groove between two capacitive projections shown by dotted lines 228 and 229, and similar to the arrangement of FIG. 16*b*. In FIG. 18*a* the waveguides 240 and 241 are shown rotated by 45° from their positions in FIGS. 18*b* and 18*d* for clarity the intermediate section 226 is shown without rotation from the position in FIG. 18*c*.

In FIG. 18*c* the corners of the ridges of the "H" are removed so as to reduce the interference with the electric field E projected from the rectangular waveguides 240 and 241 of FIG. 18*a*.

In FIG. 18*a*, the two waveguides 240 and 241 are held in place by springs (not shown) which apply pressure to the flanges 225 and 227 and press the flanges and the section 226 together to give good electrical contact. However the section 226 can be rotated over an angle of 90° with respect to the flanges 225 and 227 which are fixed relative to one another. Bearings 245 spaced at 120° facilitate rotation and a handle 246 projects from the section 226 allowing it to be rotated.

With the twist of FIG. 18*a* the polarization of the electric field may be changed by 180° in an extremely convenient way. As shown in FIGS. 18*b* to 18*d* if a wave propagates from left to right then an electric field which is in the direction indicated by the arrow in FIG. 18*b* will induce an electric field as indicated by the arrow in FIG. 18*d*. However, if the section 226 is rotated through 90° in relation to FIG. 18*c* as shown in FIG. 18*e* then the resulting electric field E in the waveguide 241 will be in the opposite direction to the arrow of FIG. 18*d*.

FIG. 19 shows an alternative cross-section for the intermediate section where pointed ridges 247 are used. As before shunt capacitive projections indicated by the dashed lines 248 are also employed. The corners 249 may be truncated Another alternative (not shown) is an intermediate section having a circular opening with radial ridges (preferably with rounded corners) which extend from the circular wall towards the centre where there is a gap. Such an arrangement has the disadvantage that higher order modes are easily generated.

The cross-section of a twist particularly suitable for use with ridge waveguides is shown with the cross-sections of adjacent waveguides coupled by the twist shown in FIGS. 20*a* and 20*b*. Shunt capacitive projections for full-band matching are indicated by the dashed lines 250.

An off-axis twist 233 is shown in FIG. 21*b* while FIGS. 21*a* and 21*c* represent two sections of rectangular waveguide 231 and 232 at right angles to one another. The waveguides 231 and 232 are coupled by the twist 233. As shown the waveguides are in "planar" form suitable for milling in a conductive block. The block has a lower portion in which the waveguide sections 231, 232 and 233 are milled and a cover 234. As an alternative the block can be cast.

As in FIGS. 16*b*, 18 and 21*b*, the twist has a ridge 235 with capacitive projections as indicated by the dotted line 236 separated by a distance of about $\lambda g/8$ at the centre of the waveguide band. The width of the horizontal and vertical limbs 237 and 238, respectively, of the twist may be reduced in width (and/or length if required) in relation to the width of the corresponding waveguide sections 231 and 232 in order to ensure that the twist has a lower characteristic impedance than the sections 231 and 232. The limbs 237 and 238 are each screened on one side where each behaves as a shunt inductance. The whole intermediate section has a reflection coefficient which varies in the way shown in FIG. 17.

Although several specific embodiments of the invention have been described it will be clear that the invention can be put into effect in many other ways. In particular either the "H" section shown or the "L" section of FIG. 21*b* may be without the capacitive projections 222 and 223 of FIG. 16*b* or equivalent if only narrow band matching is required. With reduced angles of twist the uprights of the "H" can be of reduced length. Twists giving other changes in angle of polarization can be made, for example twists similar to those of FIGS. 18*a* to 18*e*, using the principles described above.

The invention is now considered in relation to various types of tees. In FIG. 22 an E-tee is formed by three waveguides 300, 301 and 302 shown in cross-section at right angles to the broad waveguide sides. If the waveguide 302 is excited only, this tee can be considered as two right angle corners back to back together with impedance steps (from b/2 to b) since a conducting surface can be inserted, without perturbing the electromagnetic fields, in a plane which is at right angles to the drawing and contains an axis of symmetry 304. If a "reduced quarterwave transformer" 305 is introduced into the left-hand corner (and a similar reduced quarterwave transformer 306 is introduced into the right-hand corner), then the transmission path through each corner/step combination can be regarded as similar in some ways to the arrangements of FIGS. 5. Each combination can therefore be full-band matched by a matching element to one side of the reduced quarterwave transformer. In FIGS. 5 this element is a shunt inductance at the low impedance side so in FIG. 22 it is an inductive post 307 in waveguide 302. In order to match each corner respective matching elements 308 and 309 are added as explained in the paper by the present inventor entitled "Miniaturisation in E-plane technology", presented at the 15th European Microwave Conference in September 1985.

Signals propagating along the waveguide 302 are divided into equal power signals in antiphase which propagate along the waveguides 300 and 301 respectively.

The reduced quarterwave transformers 305 and 306 and the matching elements 308 and 309 may extend right across the broad dimension of the waveguides 300 and 301 but they need not do so and it is often more convenient if the transformers 305 and 306 form a first cylinder with the matching elements 308 and 309 forming a second cylinder of smaller radius, the axis 304 being the axis of rotational symmetry of both these cylinders. As will also be appreciated from the above mentioned paper on E-plane technology the matching elements 308 and 309 can be formed by a truncated cone with the base of the cone coincident with the upper periphery of the cylinder formed by the transformers 305 and 306.

FIG. 23 shows an arrangement which is equivalent to a "magic tee" in that the port formed by the waveguide 302 couples in antiphase with the ports formed by the waveguides 300 and 301, a port coupled by a coaxial line 310 also couples to the waveguides 300 and 301 but in-phase, there is no coupling between the coaxial line and the waveguide 302. The operation of the arrangement of FIG. 23 can be appreciated by considering the addition of the coaxial line 310 to the tee of FIG. 22. Since the electric field in the waveguide 302 is in the dominant mode in one direction from one broad side to the other no current is induced in the protruding central conductor of the coaxial line 310 and vice versa the signal in the coaxial line 310 does not excite a field which can propagate in the waveguide 302. On the other hand the radial electric field from the coaxial line is, when it has traversed the corners into the waveguides 300 and 301, in a form which will allow in-phase waves to propagate in these waveguides. Since the centre conductor of the coaxial line 310 is on the axis 304 it does not disturb the matching of the waveguide 302. In this example the matching elements 308 and 309 are in the truncated cone form mentioned above.

In order to match the coaxial line to the waveguides 300 and 301, the coaxial line is terminated as a monopole, as shown in FIG. 9 and is full-band matched by a reduced quarterwave transformer 311. The centre conductor of the coaxial line forms a quarter wavelength probe 312 which has a smaller diameter at its upper end in order to reduce any capacitive effect with the walls of the waveguide 302 and to reduce reflection of a wave propagating from this waveguide.

With the arrangement shown, a 50 ohm coax can be matched into the tee but if a simpler arrangement is required the reduced quarterwave transformer 311 can be omitted if a coaxial line of higher impedance is used so that there is no significant reflection. Similarly the components equivalent to the transformers 305 and 306 and the matching elements 308 and 309 may be in various forms, for example as mentioned above in relation to FIG. 22. In particular the matching elements 308 and 309 can be stepped instead of being in tapered or truncated cone form. Any waveguide to coaxial line transition, for example as shown in FIGS. 13*a* to 14*c* may be coupled to the coaxial line 310 to give a waveguide input. A suspended strip line may replace the coaxial line 310.

A microstrip tee is shown in FIG. 24 and comprises a planar conductor 315 separated from a ground plane conductor (not shown) by a dielectric layer (also not shown). Any input signal travelling along a main strip 316 forming one port is able to divide into two signals travelling along side strips 326 and 327. In this technology no matching is needed at corners 318 and 319 but the corners do form (as is known) the equivalent of a series inductance separating two shunt capacitors. If the main strip 316 and the associated ground plane together present an impedance of 50 ohms then if each of the side strips 326 and 327 at the lower end are of half the width then each will present an impedance of about 100 ohms to the even mode when one side strip "sees" the other. A gradual change of impedance to 50 ohms at the ports 320 and 321 is achieved by constant radius truncated tapers 322 and 323 which are matched by double capacitive stubs 324 and 325 in a way analogous at the high impedance side (100 ohms) to the arrangement of FIG. 6*a*.

A waveguide magic tee is shown in FIGS. 25*a*, 25*b* and 25*c*. The tee has four ports 330 to 333. The ports 330, 331 and 332 form an E-plane tee similar to that shown in FIG. 22 except that the matching elements 308 and 309 are replaced by an equivalent truncated cone 334. The reduced quarterwave transformers 305 and 306 are formed by the cylindrical component 335 which is, for convenience, manufactured as the end of a conducting cylinder 336 set in to the walls 337 of the tee. The inductive post of FIG. 25 is shown with the same designation, 307, as in FIG. 22.

An H-tee is formed by a port 333 together with the ports 331 and 332 (see FIG. 25*c*). Matching an H-tee is particularly difficult because, in this example, the wall opposite the port 333 is about a half a wavelength from the point where the waveguide from the port 333 meets the waveguides from the ports 331 and 332. As a result up to 80% of an incident wave is reflected. This difficulty can be substantially reduced by inserting a short circuit at a distance of a quarter of a wavelength from the wall 338 but since there is no top surface at the required position due to the presence of the port 330 any shorting tube has to project about a quarter of a wavelength into the port 330 where it forms an open quarter wavelength coax, so presenting, in effect, a short circuit where the surface is absent. A stub 340 having this function is shown in FIGS. 25 and it is made in planar form along the axis of the port 330 so that it does not interfere with the full-band matching of the E-tee. The stub is fairly broad in order to give broadband behaviour.

Both the height of the stub 340 and its distance from the wall 338 are important dimensions and should be as exact as possible. In order to avoid having to make these dimensions adjustable the following techniques are used. The stub 340 has the shape shown in FIG. 25*a* with the result that, at the left-hand side as shown, the length of the stub from the surface 341 surrounding the cylinder 336 is relatively short, being about half a wavelength at the high extreme of the frequencies to be handled by the tee. On the right-hand side the stub is half a wavelength long at the lowest of these frequencies. Further the left-hand side of the stub 340 is at a quarter of a wavelength for high frequencies from the wall 338 and the right-hand side (as seen in FIG. 25*a*) is at a quarter of a wavelength from this wall for low frequencies.

Waves from the port 133 excite the stub 340 which with its image in the reflecting wall 338 forms a type of folded resonator, which is resonant at a high frequency in the band. By shortening this resonator with a screw 342, the resonance shifts to a frequency above the band.

In the light of the earlier explanation of the monopole the operation of the H portion of the tee of FIG. 25 may be regarded as follows: any wave incident to the port 333 is received by the stub 340 which acts as a monopole and re-radiates such signals to the ports 331 to 332. As shown in FIG. 25 the stub 340 does not form a very satisfactory probe for this purpose but if it is separated from the periphery of the cylinder 336 it can form a coaxial line. For example a circular groove can be made in the component 336 around the stub 340. Then energy entering the coaxial line so formed is reflected back to the stub 340 and re-radiated and if the groove is of the correct depth, the reflection is in the right phase to cancel the original reflections from the H-tee towards the waveguide 333. Then the waves coupled to the waveguides 331 and 332 are enhanced because the H-tee is lossless. Such an arrangement can also be used to provide a full-band matched H-tee only when the port 330 does not exist. In this case there is no need for the equivalents of the transformers 305 and 306 and the matching elements 308 and 309 of FIG. 22 and the coaxial line terminates at the floor 341. Because the stub 340 is now short-circuited by the top surface, either directly or by way of a reactance (as at the surface 341), no parasitic resonance occurs and the shorting screw 342 is not required.

The present invention can also be applied to multiple port arrangements such as the E-plane symmetrical waveguide five port shown in FIGS. 26*a* and 26*b*. A conductive block 345 is shown in cross-section and defines five ports 346 to 350 seen with their broad dimension perpendicular to the plane of FIG. 26*a*. At the centre of the block 345 is a cylindrical waveguide 351 is bisected by a thin substrate of dielectric material in the plane of the drawing. The dielectric material is located halfway between the narrow sides of the waveguides 346 to 350 and carries five planar conducting segments such as the segment 352. The length of the cylindrical waveguide is approximately the same as the broad dimension of the waveguide ports 346 to 350. Conductive collars 353 are positioned in the waveguide 351 and project some distance into each of the waveguides 346 to 350 to form an inductive diaphragm for each waveguide.

A wave entering the port 346 encounters a step, similar to that shown in FIG. 1, where the waveguide becomes higher as it enters the waveguide 351. The impedance change is quite large so that the reference plane for this port moves out into the region 351 and can be matched by an inductance (the diaphragm formed by the collar 353 and its twin (not shown)) and the planar conductive segments acting as capacitive matching elements adjacent to the impedance step.

As is usual for five full-band matched symmetrical ports any incoming wave at one port is split into four equal power output waves. Then outgoing waves from two adjacent ports next to the input port exhibit a phase difference of 120° in relation to each other. For example in the present case an incoming wave at the port 346 excites waves at the ports 347 and 348 which are 120° out of phase with each other.

The invention is also suitable for matching interfaces in media. For example if it is required to match a dielectric block 355 in FIG. 27 to, for example, air to the left of the block then it is known to add a layer of dielectric material a quarter of a wavelength thick between air and dielectric, the dielectric constant of the quarter-wave layer being in the range between that of the air to the left of the layer and the dielectric material, for example in the range 1 to 2.5 (see E. M. T. Jones and S. B. Cohn, "Surface Matching of Dielectric Lenses", Journal of Applied Physics, Volume 26, Number 4, April 1955, pages 452 and 457). This arrangement provides narrow band matching over the range of frequencies which have quarter wavelengths approaching that of the applied layer.

In the present invention a layer 356, having a dielectric constant in the above mentioned range, is applied to the dielectric block 355 and its thickness is less than a quarter of a wavelength over the whole working frequency band of waves to propagate through the dielectric 355. The layer 356 is a quarter of a wavelength long at a frequency above the working band so that it is analogous to the arrangement shown in FIG. 3 and full-band matching can be obtained by either a distributed inductance to the right of the layer 356 or a distributed capacitance to the left. The distributed inductance may for example be a grid of conductors embedded in the material 355 as shown at 357 and the distributed capacitance may be an array of spaced apart conductive discs positioned at 358. Examples of inductive walls and capacitive walls of this type are given in the above mentioned paper by Jones and Cohn. The conductive discs must have some type of support but this can take the form of the dielectric material 356 perforated with large holes so that the dielectric constant of the support approaches that of air. The reflection coefficient of the distributed inductance or the distributed capacitance when transferred to the reference plane of the interface between the layer 355 and 356 is substantially equal and opposite to the reflection coefficient at the said reference plane over the whole working band.

It will be clear that the invention can be put into practice in many other ways that those specifically described, using different types of transmission line (such as double ridged waveguides and planar transmission lines) and different types of reactive matching elements.

Embodiments of the invention are described in the paper "An Octave-Wide Matched Impedance Step and Quarterwave Transformer", Frank C. de Ronde, IEEE-MIT-S International Microwave Symposium Digest (June 2–4, 1986, Baltimore, Md., USA) which is hereby incorporated into this specification.

I claim:

1. A twist for coupling first and second rectangular waveguides, the waveguides being oriented in a twisted relation to one another and each having corresponding transverse axes which are angularly oriented in relation to one another, the twist comprising:

conductive walls defining an opening which is positioned between first and second rectangular waveguides twisted in relation to one another, and which presents first and second interfaces to the first and second waveguides, respectively, and allows communication of electromagnetic fields between the waveguides through the opening, each said interface having a reference plane at which a reflection coefficient for waves transmitted in a first direction from the first waveguide to the second waveguide is equal and of opposite sign to a reflection coefficient for waves transmitted in a second direction from the second waveguide to the first waveguide, the walls comprising a ridge having a first axis of symmetry in said first direction, the ridge also having a second axis of symmetry transverse to said first direction and angularly oriented in relation to directions of both of said corresponding transverse axes of the first and second waveguides.

2. A twist according to claim 1, wherein the dimensions of the first and second waveguides define a frequency band of operation for the said waveguides, including matching means mounted on the ridge which in operation provides matching over at least half an octave in said frequency band.

3. A twist according to claim 2 wherein the twist provides matching over the frequency waveguides.

4. A twist according to claim 2 wherein the ridge-mounted matching means comprises first and second projections on the ridge, the projections being spaced apart on the ridge and positioned adjacent to the first and second interfaces, respectively.

5. A twist according to claim 2 wherein the said opening in constructed to provide the said matching for waveguides being in the form of ridge waveguides.

6. A twist according to claim 1 wherein said opening has two arms normal to one another and together giving the opening a cross-section in the form of an "L", and the ridge projects from the intersection of the arms of the "L".

7. A twist according to claim 1 wherein the said opening has two opposed ridges which give the opening a cross-section in the form of an "H".

8. A twist according to claim 7 wherein each ridge supports matching means in the form of a pair of spaced projections, each projection being transverse to the ridge on which it is mounted.

9. A twist according to claim 1 including assembly means for positioning, as required in operation, in either one of first and second different angular positions relative to the first and second waveguides and in one of these positions a wave having a first polarization in one of the waveguides has a second polarization in the other waveguide while when the twist is in the other position the wave having the first polarization in the said one waveguide has a third polarization in the said other waveguide, the second and third polarizations being 180° apart.

10. A twist according to claim 1 including coupling means for coupling the twist between the first and second waveguides, the coupling means being arranged to allow the twist to be rotated with respect to the first and second waveguides.

11. Apparatus according to claim 1 further comprising coupled at said first and second interfaces the first and second rectangular waveguides, respectively.

12. Apparatus according to claim 11 wherein the first and second rectangular waveguides are ridge waveguides.

13. A twist according to claim 1 further comprising first matching means mounted on the ridge and second and third matching means, mounted in the first and second waveguides, respectively, which provide matching over at least half an octave in a frequency band of operation of the first and second waveguides.

14. Apparatus comprising a twist combined at first and second interfaces with first and second rectangular waveguides which are oriented, in operation, in a twisted relation to one another, the waveguides having corresponding transverse axes which are angularly orientated in relation to one another, and the twist comprising conductive walls, defining an opening which is positioned between two rectangular waveguides twisted in relation to one another, and allows communication of electromagnetic fields between the waveguides through the opening, each interface having a reference plane at which a refection coefficient for waves transmitted from a waveguide associated with said each interface towards the reference plane of said each interface in a first direction from the first waveguide to the second waveguide is equal and of opposite sign to a reflection coefficient for waves transmitted towards the reference plane of said each interface in a second direction from the second waveguide to the first waveguide, the walls comprising a ridge having a first axis of symmetry in said first direction and the ridge also having a second axis of symmetry transverse to said first direction which is angularly oriented in relation to directions of both of the corresponding transverse axes of the waveguides, the apparatus also including matching means positioned to have a reflection coefficient at the said reference plane which is substantially equal and opposite to the said reflection coefficient of the twist and the interfaces at the said reference plane over a frequency band corresponding to at least half an octave in wavelength for said first and second directions of transmission through the twist.

15. Apparatus according to claim 14 wherein the matching means comprises a pair of spaced projections mounted on the ridge.

16. Apparatus according to claim 15 including coupling means for coupling the twist between the first and second waveguides, the coupling means including rotating means to allow the twist to be rotated with respect to the first and second waveguides.

17. Apparatus according to claim 15 wherein the said reflection coefficient of the twist and the interfaces have a magnitude which decreases with frequency across said frequency band, and each projection of the said pair of projections is spaced from the other by a distance equal to a quarter of the guide wavelength at a frequency above the said frequency band.

18. Apparatus according to claim 15 wherein said opening has two arms normal to one another and together giving the opening a cross section in the form of an "L", and wherein the ridge projects from an intersection of arms of the "L".

19. Apparatus according to claim 15 having assembly means for positioning the twist, as required in operation, in either one of first and second different angular positions relative to the two waveguides and in one of these positions a wave having a first polarization in one of the waveguides has a second polarization in the other waveguide while when the twist is in the other position the wave having the first polarization in the said one waveguide has a third polarization in the said other waveguide, the second and third polarizations having a difference of 180°.

20. Apparatus according to claim 14 wherein the said opening has two opposed ridges which give the opening a cross-section in the form of an "H", and the matching means comprises two pairs of spaced projections, one pair mounted on each ridge, each projection being transverse to the ridge on which it is mounted.

21. Apparatus according to claim 20 wherein said reflection coefficients have a magnitude which decreases with frequency across said frequency band, and the projection of each said pair of projections is spaced from the other projection of that pair by a distance equal to a quarter of the guide wavelength at a frequency above the said frequency band.

22. Apparatus comprising a twist combined, at first and second interfaces, with first and second rectangular waveguides which are oriented in a twisted relation to one another, the waveguides having corresponding transverse axes which are angularly orientated in relation to one another, and the twist comprising conductive walls, defining an opening which is positioned between two rectangular waveguides which are twisted in relation to one another, and allows communication of electromagnetic fields between the waveguides through the opening;

each interface having a reference plane at which a reflection coefficient for waves transmitted from a waveguide associated with said each interface towards the reference plane of said each interface in a first direction from the first waveguide to the second waveguide is equal and of opposite sign to a reflection coefficient for waves transmitted towards the reference plane of said interface in a second direction from the second waveguide to the first waveguide, the walls comprising a ridge having a first axis of symmetry in the said first direction and the ridge also having a second axis of symmetry transverse to said first direction which is angularly oriented in relation to the directions of both of said corresponding transverse axes of the waveguides, the apparatus also including first and second matching means corresponding to the first and second interfaces, respectively, each positioned to have a reflection coefficient at the said reference plane which is substantially equal and opposite to the reflection coefficient of the corresponding interface at the said reference plane over a frequency band corresponding to at least half an octave in wavelength and for each direction of transmission through the twist.

23. Apparatus according to claim 22 wherein the rectangular waveguides are ridge waveguides.

24. Apparatus according to claim 22 wherein each matching means comprises two capacitive elements for each interface, one capacitive element in the waveguide adjacent to that interface and another capacitive element mounted on the ridge in the twist.

* * * * *